US008656540B2

(12) United States Patent
Chen

(10) Patent No.: US 8,656,540 B2
(45) Date of Patent: Feb. 25, 2014

(54) AIR MATTRESS

(71) Applicant: Apex Billion Int'l Inv. Ltd., Taipei (TW)

(72) Inventor: Yuan-Chen Chen, Taoyuan County (TW)

(73) Assignee: Apex Billion Int'l Inv. Ltd., Taipei (TW)

( * ) Notice: Subject to any disclaimer, the term of this patent is extended or adjusted under 35 U.S.C. 154(b) by 0 days.

(21) Appl. No.: 13/747,489

(22) Filed: Jan. 23, 2013

(65) Prior Publication Data

US 2013/0180052 A1 Jul. 18, 2013

Related U.S. Application Data

(63) Continuation-in-part of application No. 13/541,760, filed on Jul. 4, 2012.

(60) Provisional application No. 61/570,255, filed on Dec. 13, 2011, provisional application No. 61/706,137, filed on Sep. 27, 2012.

(30) Foreign Application Priority Data

Dec. 13, 2012 (CN) ..... 2012 2 0688334 U

(51) Int. Cl.
*A47C 27/08* (2006.01)

(52) U.S. Cl.
USPC ..... 5/711; 5/710

(58) Field of Classification Search
USPC ..... 5/710–712, 706, 655.3
See application file for complete search history.

(56) References Cited

U.S. PATENT DOCUMENTS 6,983,502 B2 1/2006 Boyd
7,152,264 B2 12/2006 Boyd
7,353,555 B2 * 4/2008 Lau ..... 5/711

* cited by examiner

*Primary Examiner* — Fredrick Conley
(74) *Attorney, Agent, or Firm* — Jianq Chyun IP Office

(57) ABSTRACT

An air mattress includes an inflatable compartment, strips and decoration strips. The inflatable compartment includes a top wall, a bottom wall and a side wall surrounding the peripheries of the top wall and the bottom wall. The strips are air pervious and disposed in the inflatable compartment. The strips are connected between the top wall and the bottom wall. The decoration strips surround the top wall and are connected between the top wall and the side wall, so that the side wall is formed into a first layer portion and a second layer portion.

9 Claims, 19 Drawing Sheets

AIR MATTRESS

CROSS-REFERENCE TO RELATED APPLICATION

This application is a continuation-in-part application of and claims the priority benefit of U.S. application Ser. No. 13/541,760, filed on Jul. 4, 2012, now pending. The U.S. application Ser. No. 13/541,760 claims the priority benefit of U.S. provisional application Ser. No. 61/570,255, filed on Dec. 13, 2011. This application also claims the priority benefits of U.S. provisional application Ser. No. 61/706,137, filed on Sep. 27, 2012 and China application serial no. 201220688334.9, filed on Dec. 13, 2012. The entirety of each of the above-mentioned patent applications is hereby incorporated by reference herein and made a part of this specification.

BACKGROUND OF THE INVENTION

1. Field of Invention

The present invention generally relates to an air mattress, and particularly to an air mattress which has decoration strips.

2. Description of Related Art

Conventional air mattresses (air beds) are convenient to carry outdoor, since users can use them to take a rest and before use just inflating the air mattress is needed. Air mattresses generally include strips so as to stretch the inner walls of the air mattresses after inflated.

The aforementioned air mattresses are only single-layered structures. If the air mattress needs to increase an extra layer structure, the conventional method is to assemble two single-layered air mattresses to form a two-layered structure. However, this assembling method would become inefficient if air mattresses having more than two layers are required. Or even if they are assembled, individually inflating each of the air mattresses is necessary and causes great inconvenience.

SUMMARY OF THE INVENTION

The present invention provides an air mattress and through the decoration strips thereof the side wall may be formed into a plurality of layer portions.

An exemplary embodiment of the present invention provides an air mattress including an inflatable compartment, a plurality of strips and a plurality of decoration strips. The inflatable compartment includes a top wall, a bottom wall and a side wall surrounding peripheries of the top wall and the bottom wall. The strips are air pervious and disposed in the inflatable compartment. The strips are connected to the top wall and the bottom wall. The decoration strips surrounds the top wall and are connected between the top wall and the side wall, so that the side wall is formed into a first layer portion and a second layer portion.

According to an exemplary embodiment of the present invention, each of the strips has a first supporting portion, a second supporting portion and a third supporting portion. The end of the second supporting portion outwardly extends to form a first reserved portion. The end of the third supporting portion outwardly extends to form a second reserved portion. The first reserved portion is connected to the second reserved portion, so that the first supporting portion, the second supporting portion and the third supporting portion face the side wall.

According to an exemplary embodiment of the present invention, each of the strips has a first connecting portion and a second connecting portion. The first connecting portion is located between the first supporting portion and the second supporting portion. The second connecting portion is located between the first supporting portion and the third supporting portion. The first connecting portion faces the top wall and is connected to the top wall. The second connecting portion faces the bottom wall and is connected to the bottom wall.

According to an exemplary embodiment of the present invention, each of the strips has a plurality of first connecting portions and a plurality of second connecting portions. The first connecting portions are located between the first supporting portion and the second supporting portion. The second connecting portions are located between the first supporting portion and the third supporting portion. The first connecting portions face the top wall and are respectively connected to the top wall. The second connecting portions face the bottom wall and are respectively connected to the bottom wall.

According to an exemplary embodiment of the present invention, an upper end and a lower end of each of the decoration strips and two ends of a decoration portion of the top wall are respectively connected, and a dragging portion of each of the decoration strips and the side wall are connected.

According to an exemplary embodiment of the present invention, another inflatable compartment consists of the decoration strips and the decoration portion of the top wall, and a height of the decoration strips is greater than a height of a lying portion of the top wall, the decoration portion is formed at a periphery of the lying portion.

According to an exemplary embodiment of the present invention, the air mattress further includes a peripheral strip. The peripheral strip is air pervious, disposed in the inflatable compartment, surrounds the strips and is connected to the bottom wall and the side wall, so that the side wall is formed into a first layer portion, a second layer portion and a third layer portion.

According to an exemplary embodiment of the present invention, the peripheral strip has a dragging portion. The upper end and the lower end of the dragging portion are respectively connected to the side wall and the bottom wall.

According to an exemplary embodiment of the present invention, the air mattress further includes a first peripheral strip and a second peripheral strip. The first peripheral strip and the second peripheral strip are air pervious and disposed in the inflatable compartment. The first peripheral strip surrounds the strips and is connected to the side wall and the top wall, and the second peripheral strip surrounds the strips and is connected to the side wall and the bottom wall, so that the side wall is formed into the first layer portion, the second layer portion, a third layer portion and a fourth layer portion.

According to an exemplary embodiment of the present invention, the first peripheral strip has a dragging portion. The upper end and the lower end of the dragging portion are respectively connected to the side wall and the bottom wall.

In light of the above, in the present invention, through the decoration strips, the air mattress may be formed into a two-layered structure of the side wall. In such configuration, through the disposing of decoration strips, without needing to stack an extra mattress onto the air mattress, the mattress can be formed into a two-layered side wall. The overall appearance of the air mattress is further improved. In addition, through the structure design of the strips of the air mattress of the present invention, the user would feel much more comfortable when using the air mattress, and the expansion deformation of the top wall and the bottom wall after the air mattress is inflated can be reduced, thus the overall appearance of the air mattress can be smoother and squarer and the air mattress has a better appearance.

In order to make the aforementioned and other features and advantages of the present invention more comprehensible, several embodiments accompanied with figures are described in detail below.

DESCRIPTION OF EMBODIMENTS

Figure 1:
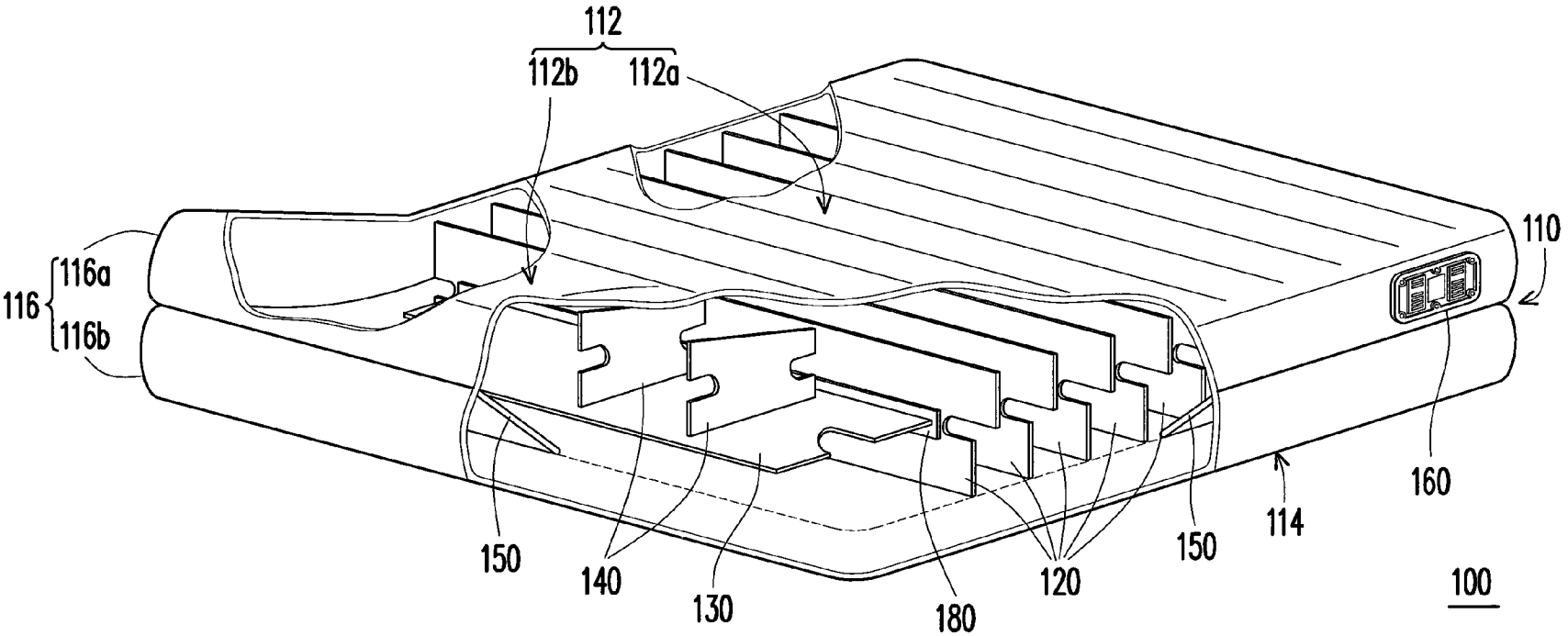
FIG. 1 is a perspective view of an air mattress according to an exemplary embodiment of the present invention.
Figure 2:
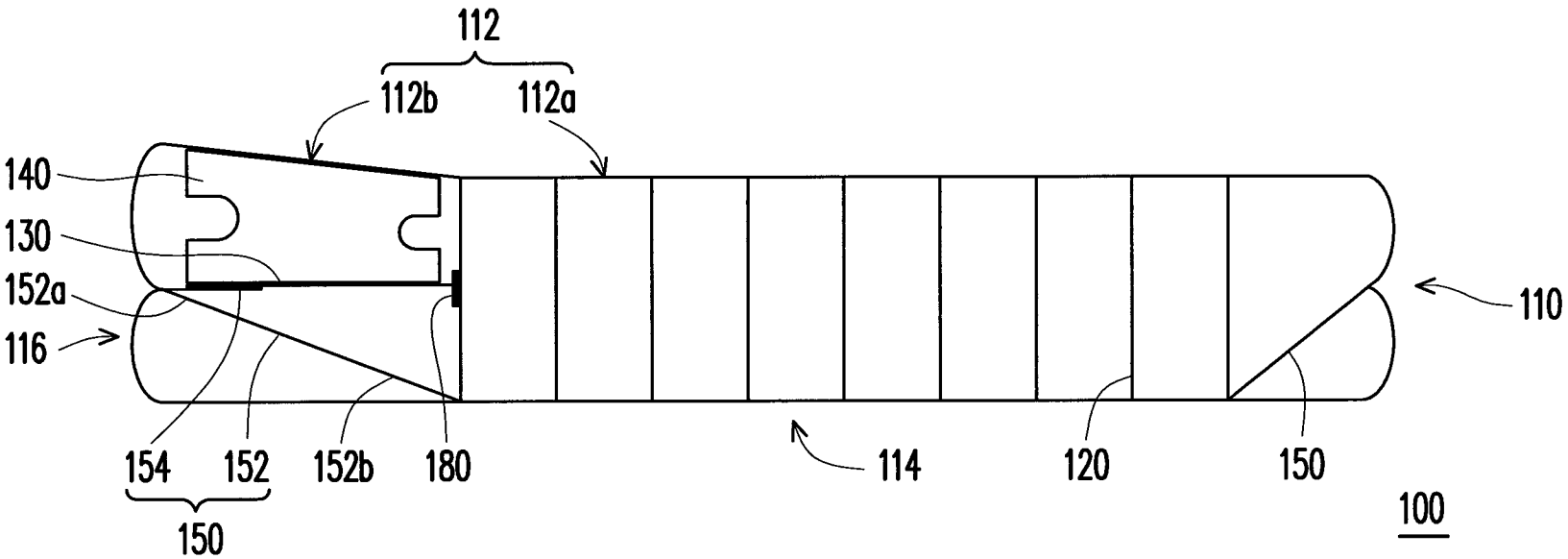
FIG. 2 is a schematic cross-sectional view along the length direction of the air mattress of FIG. 1.

FIG. 1 is a perspective view of an air mattress according to an exemplary embodiment of the present invention. FIG. 2 is a schematic cross-sectional view along the length direction of the air mattress of FIG. 1. Referring to FIG. 1 and FIG. 2, in the embodiment, the air mattress 100 includes an inflatable compartment 110, strips 120, a connecting sheet 130 and pillow strips 140. The inflatable compartment 110 is formed by a top wall 112, a bottom wall 114 and a side wall 116 surrounding thereto, wherein the side wall 116 surrounds the peripheries of the top wall 112 and the bottom wall 114. In the embodiment, the strips 120, the connecting sheet 130 and the pillow strips 140 are disposed in the inflatable compartment 110. The strips 120 are arranged substantially parallel to the width direction of the air mattress 100 and respectively connected between the bottom wall 114 and the lying portion 112*a* of the top wall 112.

Specifically, in order to form the comparatively higher pillow portion on the air mattress 100, the side wall 116 (referring to FIG. 5A) of the embodiment is designed to have regions with different heights. Thus, when the side wall 116 and the top wall 112 are jointed to each other, the middle protruding region of the side wall 116 may provide the top wall 112 a larger inflated space, so as to form the pillow portion 112*b*, wherein the height H2 of the side wall 116 adjacent to the pillow portion 112*b* is greater than the height H1 of the side wall 116 adjacent to the lying portion 112*a*.

In such configuration, due to the different heights of the side wall 116, the lying portion 112*a* and the pillow portion 112*b* protruded from the lying portion 112*a* can be formed on the top wall 112 of the air mattress 100. Accordingly, the user can pillow on the pillow portion 112*b* of the top wall 112 when lying on the air mattress 100 and does not need to prepare any other pillow or something having pillow function. However, when the inflatable compartment 110 of the air mattress 100 is inflated and if the pillow portion 112*b* is not fixed by using specific structures in the inflatable compartment 110, the surface of the pillow portion 112*b* may be too inflated to be stable and it may further cause inconvenience for users to lie thereon.

In the embodiment, the pillow strips 140 and the connecting sheet 130 are used so that the surface of the pillow portion 112*b* of the air mattress 100 may comparatively be leveled and the comfort can be increased. It is further described with examples in the following.

The connecting sheet 130 faces the pillow portion 112*b* of the top wall 112 and connected between the side wall 116 and the strip 120 nearest to the pillow portion 112*b*. Moreover, the strips 140 are arranged substantially parallel to the length direction of the air mattress 100 and respectively connected between the pillow portion 112*b* of the top wall 112 and the connecting sheet 130. Therefore, through the design of the pillow strips 140 and the connecting sheet 130, the pillow portion 112*b* may not be too inflated, thus the surface of the pillow portion 112*b* may relatively be more stable and the comfort of the air mattress 100 can be greatly improved.

In addition, each of the strips 120 (referring to FIG. 5B), the connecting sheet 130 (referring to FIG. 5C) and the pillow strips 140 (referring to FIG. 5D) has a recess 122, 132, 142 at each side. Therefore, the air within the inflatable compartment 110 may pass through among the recesses 122, 132, 142, the two not-jointed sides of the strips 120, the two not jointed sides of the connecting sheet 130 and the two not-jointed sides of the pillow strips 140, so that the strips 120, the connecting sheet 130 and the pillow strips 140 are air-pervious. Accordingly, the air within the inflatable compartment 110 can flow and no air-flow prevention is caused within the inflatable compartment 110.

In addition, the inflatable compartment 110 is made by an air-impermeable material, for example a plastic material such as polyvinyl. Thus, after the inflatable compartment 110 of the air mattress 100 is inflated, the air cannot leak out and is maintained within the inflatable compartment 110. In addition, the strips 120, the connecting sheet 130, the pillow strips 140 and other components may be made by the aforementioned polyvinyl or other materials.

Figure 3:
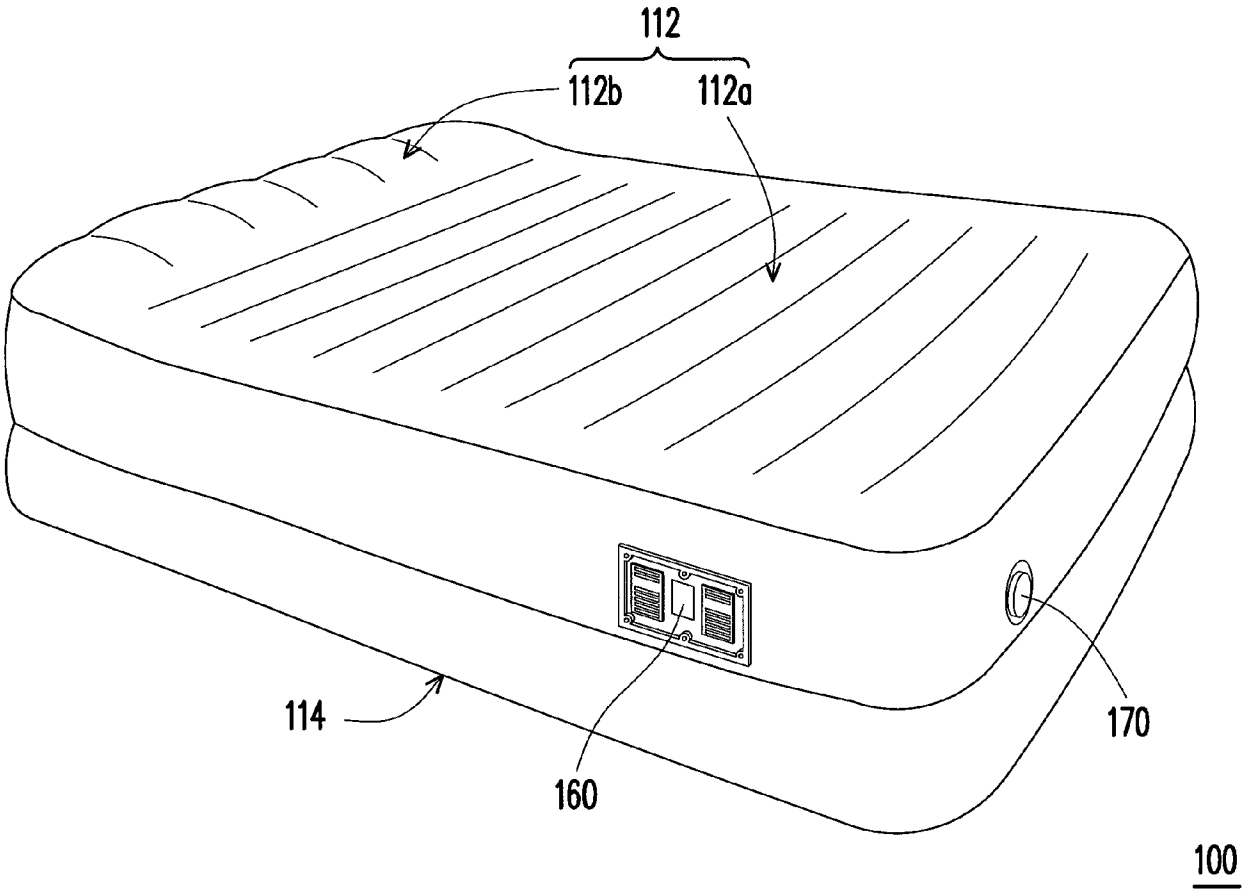
FIG. 3 is a perspective view of the air mattress of FIG. 1 in another viewing angle.

FIG. 3 is a perspective view of the air mattress of FIG. 1 in another viewing angle. In the embodiment, the air mattress 100 further includes an inflating device 160 and a deflating valve 170 respectively disposed on the side wall 116. Accordingly, the air mattress 100 can be inflated through the inflating device 160. On the other hand, the air of the inflatable compartment 110 of the air mattress 100 can be deflated through the deflating valve 170, when the air mattress 100 is not used. In other embodiments, inflating device and/or deflating valve can be disposed on the side wall 116 of the air mattress 100 as required.

Figure 4:
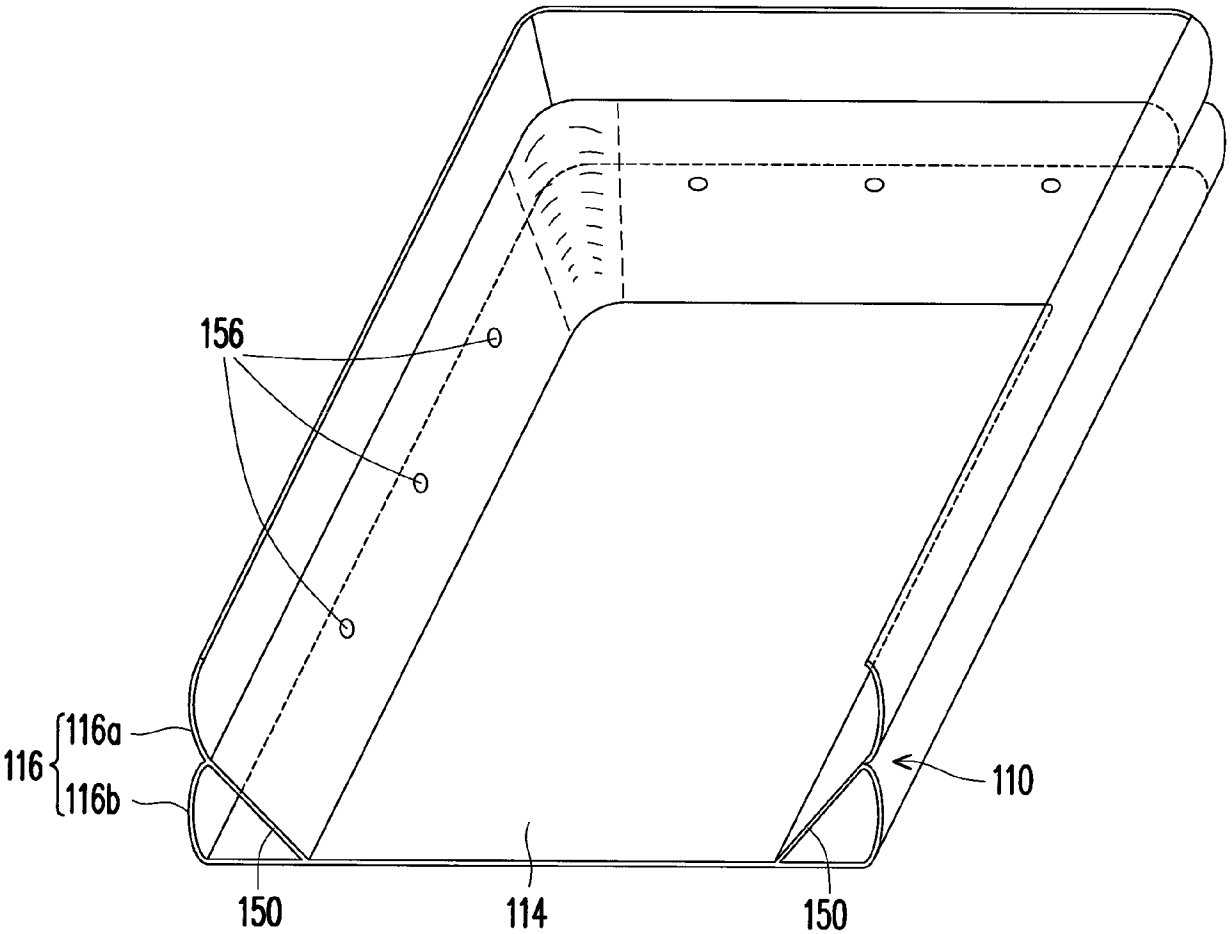
FIG. 4 schematically shows a perspective view of a portion of the air mattress of FIG. 1.

FIG. 4 schematically shows a perspective view of a portion of the air mattress of FIG. 1. Herein the top wall 112, the strips 120, the connecting sheet 130 and the pillow strips 140 of FIG. 1 and FIG. 2 are omitted in FIG. 4, in order to clearly illustrate the corresponding relation between the components. Referring to FIG. 2 and FIG. 4, in the embodiment, the air mattress 100 further includes four peripheral strips 150 respectively disposed in the inflatable compartment 110. Each of the peripheral strips 150 is incliningly connected between the bottom wall 114 and the side wall 116, and the peripheral strips 150 are connected to each other and surround the strips 120. In other embodiments, the quantity of the peripheral strips 150 may be other suitable number and the peripheral strips are connected to each other and surround the strips 120, or only one integrated peripheral strip 150 may surround the strips 120, but the present invention is not limited thereto. On the other hand, another end of each of the peripheral strips 150 is connected to the corresponding side wall 116, so that the side wall 116 is formed into a first layer portion 116*a* and a second layer portion 116*b*. In other words, through the peripheral strips 150, the user can obtain the side wall 116 with a double-layered structure and no need to stack an extra mattress onto the air mattress 100.

More specifically, as shown in FIG. 2, each of the peripheral strips 150 has a dragging portion 152 and a reserved portion 154 extending from the upper end 152*a* of the dragging portion 152. The upper end 152*a* of the dragging portion 152 and the lower end 152*b* of the dragging portion 152 are connected to the side wall 116 and the bottom wall 114, respectively. At least a portion of the reserved portion 154 is connected to the connecting sheet 130. The method of the reserved portion 154 connecting to the connecting sheet 130 is not limited in the present invention, for example by adhesive bonding method or thermal welding method. For example, the reserved portion 154 is connected to the connecting sheet 130 by using the thermal welding method so that the connection can be more stable. Thus, the connection between the reserved portion 154 and the connecting sheet 130 is hard to break, after the air mattress 100 is inflated.

In the present embodiment, the air mattress 100 further includes a reinforcing sheet 180 (as shown in FIG. 2). The reinforcing sheet 180 is disposed on the strip 120 adjacent to the pillow portion 112*b* and connected to the connecting sheet 130. In the embodiment, the method of the reinforcing sheet 180 connecting to the connecting sheet 130 is not limited in the present invention, for example by adhesive bonding method or thermal welding method. For example, the reinforcing sheet 180 is connected to the connecting sheet 130 by using the thermal welding method so that the connection can be more stable. Thus, the connection between the reinforcing sheet 180 and the connecting sheet 130 is hard to break, after the air mattress 100 is inflated.

Figure 5A:
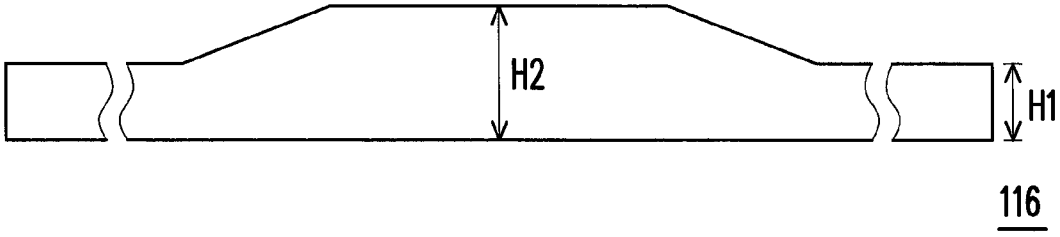
FIG. 5A shows the expanded view of the side wall of FIG. 1.
Figure 5B:
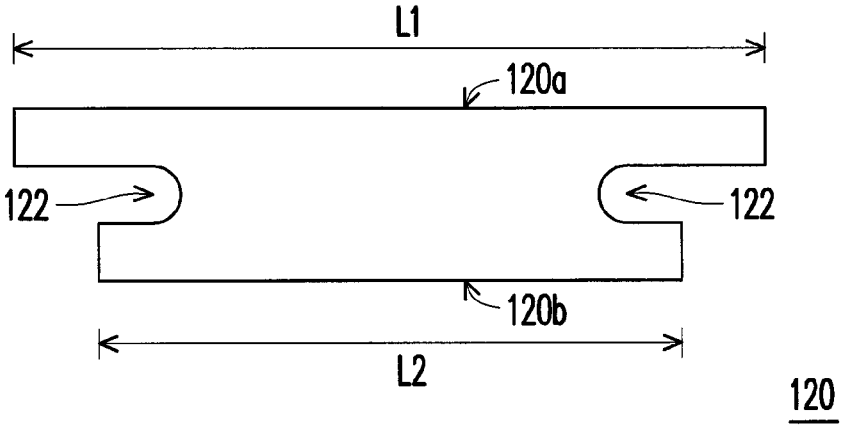
FIG. 5B shows the expanded view of a strip of FIG. 1.
Figure 5C:
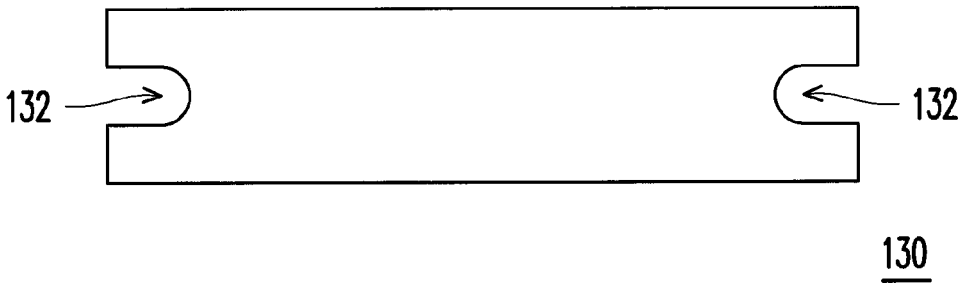
FIG. 5C shows the expanded view of the connecting sheet of FIG. 1.
Figure 5D:
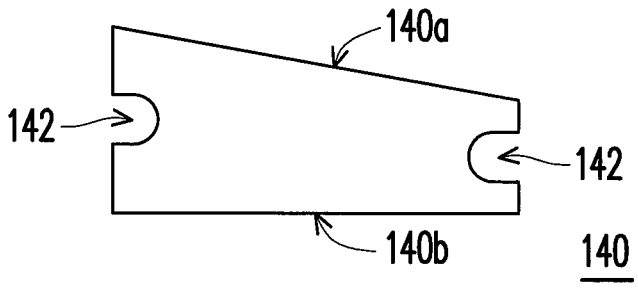
FIG. 5D shows the expanded view of a pillow strip of FIG. 1.
Figure 5E:
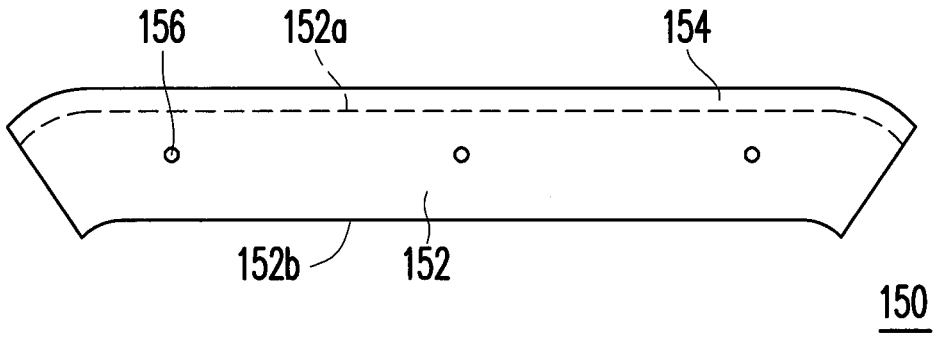
FIG. 5E shows the expanded view of a peripheral strip of FIG. 1.

The shapes of the aforementioned side wall 116, the strip 120, the connecting sheet 130, the pillow strips 140 and the peripheral strips 150 are not limited in the present invention and described accompanying with figures in the following. FIG. 5A shows the expanded view of the side wall of FIG. 1. FIG. 5B shows the expanded view of a strip of FIG. 1. FIG. 5C shows the expanded view of the connecting sheet of FIG. 1. FIG. 5D shows the expanded view of a pillow strip of FIG. 1. FIG. 5E shows the expanded view of a peripheral strip of FIG. 1. Referring to FIG. 5A, FIG. 1, FIG. 2 and FIG. 3, in the embodiment, the height H2 of the side wall 116 of the adjacent to the pillow portion 112*b* is greater than the height H1 of the side wall 116 adjacent to the lying portion 112*a*.

Next, referring to FIG. 5B, FIG. 1 and FIG. 2, the upper edge 120*a* of each of the strips 120 and the lower edge 120*b* of each of the strips 120 are connected to the top wall 112 and the bottom wall 114, respectively. Each of the strips 120 has a recess 122 substantially in a half-circle shape at each side. In the embodiment, the length L1 of the upper edge 120*a* of each of the strips 120 is greater than the length L2 of the lower edge 120*b* of each of the strips 120. Thus, after the lower edge 120*b* of each of the strips is connected to the bottom wall 114, some extra space may still be left for the peripheral strip 150 to surround thereon. In addition, each of the strips 120 is connected between the top wall 112 and the bottom wall 114, and after the air mattress 100 is inflated, the recesses 122 formed at two sides of each strip 120 may buff the tensile force of the top wall 112 and the bottom wall 114 exerting on the strips 120. Thus, after the inflatable compartment 110 of the air mattress 100 is inflated, the design of the recesses 122 disposed on two sides of each of the strips 120 may greatly prevent the strips 120 connected between the edges 120*a*, 120*b* of the top wall 112 and the bottom wall 114 from being extracted from the top wall 112 and the bottom wall 114 connected therebetween or the strips 120 from being broken.

Referring to FIG. 5C, FIG. 1 and FIG. 2 together, in the embodiment, the connecting sheet 130 has a substantially-half-circle shaped recess 132 at each side. After the air mattress 100 is inflated, the recesses 132 of the connecting sheet 130 may buff the tensile force of the side wall 116 and adjacent the strips 120 exerting thereon. Thus, after the inflatable compartment 110 of the air mattress 100 is inflated, the design of the recesses 132 disposed on two sides of the connecting sheet 130 may greatly prevent the connecting sheet 130 from being extracted from the side wall 116 and/or the strips 120 connected therebetween or the connecting sheet 130 from being broken. Similarly, as shown in FIG. 5D, the recesses 142 of the pillow strips 140 may buff the tensile force of the pillow portion 112*b* and the connecting sheet 130 exerting on the pillow strips 140. Thus, after the inflatable compartment 110 of the air mattress 100 is inflated, the design of the recesses 142 disposed on two sides of each of the pillow strips 140 may greatly prevent the pillow strips 140 from being extracted from the pillow portion 112*b* and the connecting sheet 130 connected therebetween or the pillow strips 140 from being broken. In addition, the length direction of the edge 140*a* of each of the pillow strips 140 is tilted to the length direction of another edge 140*b* of each of the pillow strips 140.

Referring to FIG. 5E, FIG. 1 and FIG. 2, the peripheral strip 150 has a plurality of through holes 156. Therefore, the air within the inflatable compartment 110 may flow through the through holes 156, so that the peripheral strip 150 is air-pervious and may not cause the air-flow prevention within the inflatable compartment 110. However, besides the through holes 156 may not cause air-flow prevention within the inflatable compartment 110, the through holes 156 may also provide damping to the peripheral strip 150 from being exerted by tensile force of the bottom wall 114 and the side wall 116. Thus, after the inflatable compartment 110 of the air mattress 100 is inflated, the design of the through holes 156 may greatly prevent the peripheral strip 150 from being extracted from the bottom wall 114 and/or the side wall 116 connected therebetween or the peripheral strip 150 from being broken.

Figure 6:
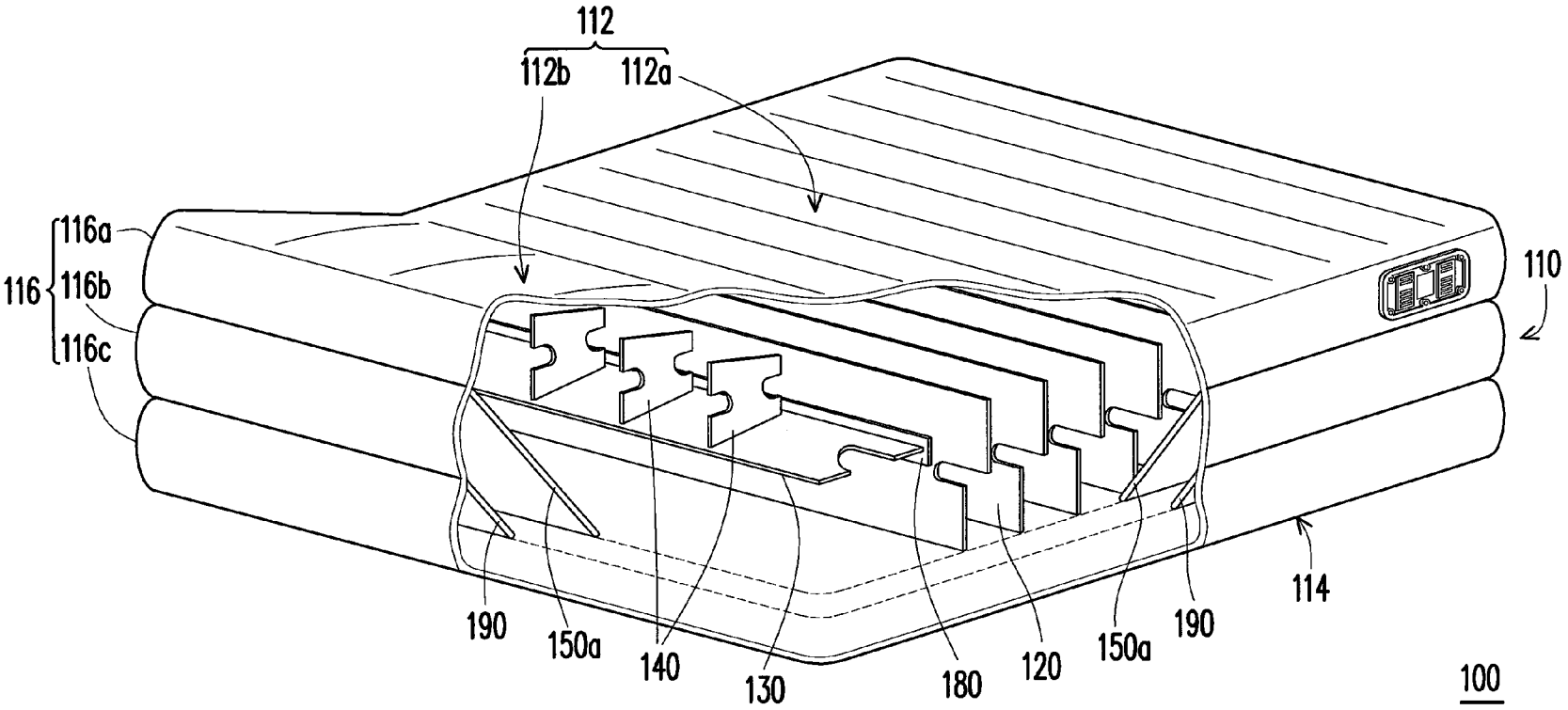
FIG. 6 is a perspective view of an air mattress according to another exemplary embodiment of the present invention.

FIG. 6 is a perspective view of an air mattress according to another exemplary embodiment of the present invention. Referring to FIG. 6, in the air mattress 100 of the embodiment, the strips 120, the connecting sheet 130 and the pillow strips 140 are air-pervious and disposed in the inflatable compartment 110. The strips 120 are arranged substantially parallel to the width direction of the air mattress 100 and respectively connected between the bottom wall 114 and the lying portion 112*a* of the top wall 112. The connecting sheet 130 faces the pillow portion 112*b* of the top wall 112 and connected between the side wall 116 and the strip 120 nearest to the pillow portion 112*b*. The pillow strips 140 are arranged substantially parallel to the length direction of the air mattress 100 and connected between the connecting sheet 130 and the pillow portion 112*b* of the top wall 112.

In the embodiment, the air mattress 100 further includes a first peripheral strip 150*a* and a second peripheral strip 190, wherein the first peripheral strip 150*a* and the second peripheral strip 190 are connected to the side wall 116 and have different heights. The peripheral strips 150, 190 are air-pervious and disposed in the inflatable compartment 110 and surround the strips 120. The lower ends of the first peripheral strip 150*a* and the second peripheral strip 190 are incliningly connected to the bottom wall 114, and the upper ends are respectively connected to the side wall 116 with different heights, so that the side wall 116 is formed into a first layer portion 116*a*, a second layer portion 116*b* and a third layer portion 116*c*. Thus, through the first peripheral strip 150*a* and the second peripheral strip 190, the air mattress 100 can formed into a side wall 116 with three-layered structure.

The functions and shapes of the reinforcing sheet 180 shown in FIG. 6 and the aforementioned side wall 116, strips 120, connecting sheet 130, pillow strips 140, first peripheral strip 150*a* and second peripheral strip 190 are similar or the same to the functions and shapes of the reinforcing sheet, side wall, strips, connecting sheet, pillow strips and peripheral strip of the air mattress of the aforementioned first embodiment shown in FIG. 1, thus the detailed description of the design can be referred to FIG. 1, FIG. 2, FIG. 3 and FIG. 5A to FIG. 5E, and it is not repeated herein.

The aforementioned first embodiment shown in FIG. 1 and second embodiment shown in FIG. 6, as shown in FIG. 5C, through the connecting sheet 130 disposed horizontally, each of the pillow strips 140 is connected to the pillow portion 112*b* of the top wall 112 and the connecting sheet 130. However, the present invention is not limited thereto, and examples are described accompanying with figures in the following.

Figure 7:
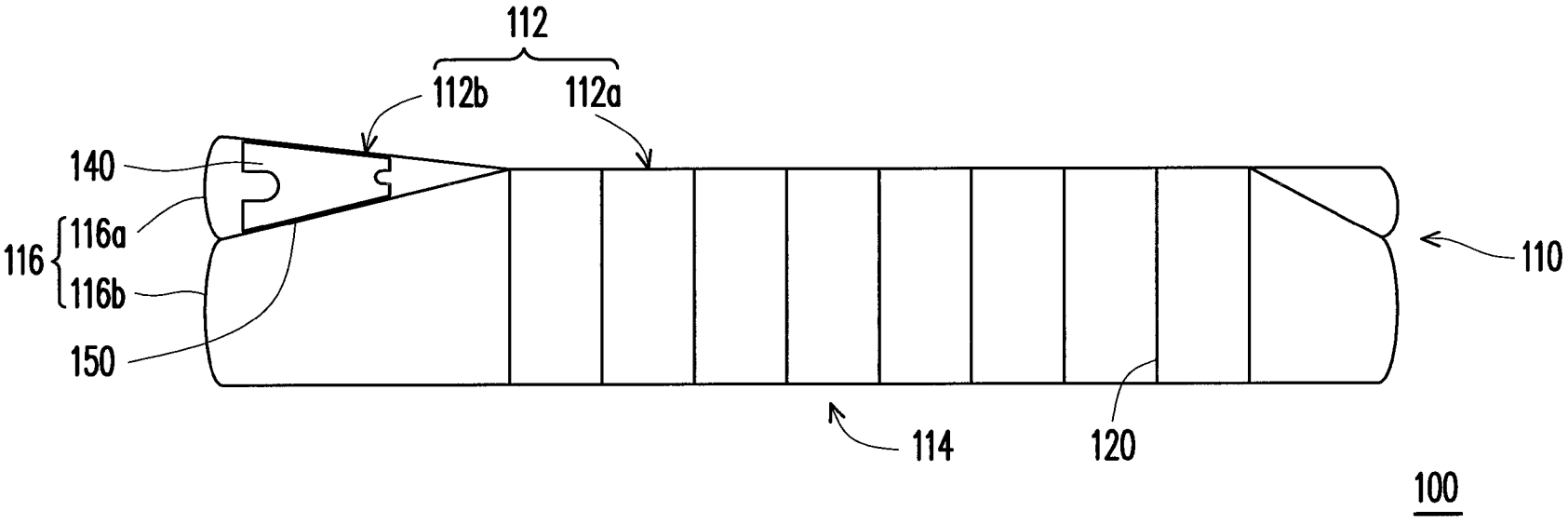
FIG. 7 is a cross-sectional view of an air mattress along the length direction according to another exemplary embodiment of the present invention.

FIG. 7 is a cross-sectional view of an air mattress along the length direction according to another exemplary embodiment of the present invention. Referring to FIG. 7, the air mattress 100 includes an inflatable compartment 110, a plurality of strips 120, a peripheral strip 150 and a plurality of pillow strips 140, wherein the strips 120, the peripheral strip 150 and the pillow strips 140 are air-pervious disposed in the inflatable compartment 110. The inflatable compartment 110 includes a top wall 112, a bottom wall 114 and a side wall 116 surrounding peripheries of the top wall 112 and the bottom wall 114.

As mentioned, the top wall 112 includes a pillow portion 112*b* and a lying portion 112*a*. The strips 120 are arranged substantially parallel to the width direction of the air mattress 100 and respectively connected between the bottom wall 114 and the lying portion 112*a* of the top wall 112. In the embodiment, the peripheral strip 150 surrounds the strips 120 and incliningly connected between the side wall 116 and the top wall 112, so that the side wall 116 is formed into a first layer portion 116*a* and a second layer portion 116*b*. The pillow strips 140 are arranged substantially parallel to the length direction of the air mattress 100 and directly connected between the peripheral strip 150 and the pillow portion 112*b* of the top wall 112.

In the embodiment, as shown in FIG. 7, the air mattress 100 has no connecting sheet disposed therein as the above mentioned embodiments, thus the lower edge of each of the pillow strips 140 are connected to the peripheral strip 150 instead of being connected to the connecting sheet. The air mattress 100 of the embodiment can make the pillow strips 140 fixed without the connecting sheet. In the embodiment, the peripheral strip 150 is incliningly connected between the side wall 116 and the top wall 112, in order that the side wall 116 is formed into two layer portions 116*a* and 116*b*. Accordingly, by such configuration, compared to the above mentioned embodiments, the air mattress 100 of the present embodiment can save the material and manufacturing cost and labor of the connecting sheet and the reinforcing sheet, and the appearance of the air mattress 100 can be more artistic.

No connecting sheet and reinforcing sheet are included in the present embodiment. In addition, the functions and shapes of the side wall 116, strips 120, pillow strips 140, peripheral strip 150 are similar or the same to the functions and shapes of the side wall, strips, pillow strips and peripheral strip of the air mattress of the aforementioned first embodiment (referred to FIG. 1), thus the detailed description of the design can be referred to FIG. 1, FIG. 2, FIG. 3 and FIG. 5A to FIG. 5E, and it is not repeated herein. However, it has to be noted that the height of the pillow strips 140 is smaller located relatively nearer to the connecting location of the peripheral strip 150 and the top wall 112, since the lower edge of each of the strips 140 is directly connected on the peripheral strip 150.

In addition, in the embodiment as shown in FIG. 7 and other embodiments, quantity of the peripheral strip with different heights connected to the side wall is not limited in the present invention. In other words, quantity of the layer structure formed by the side wall is not limited in the air mattress of other embodiments of the present invention, and examples are described accompanying with figures in the following.

Figure 8:
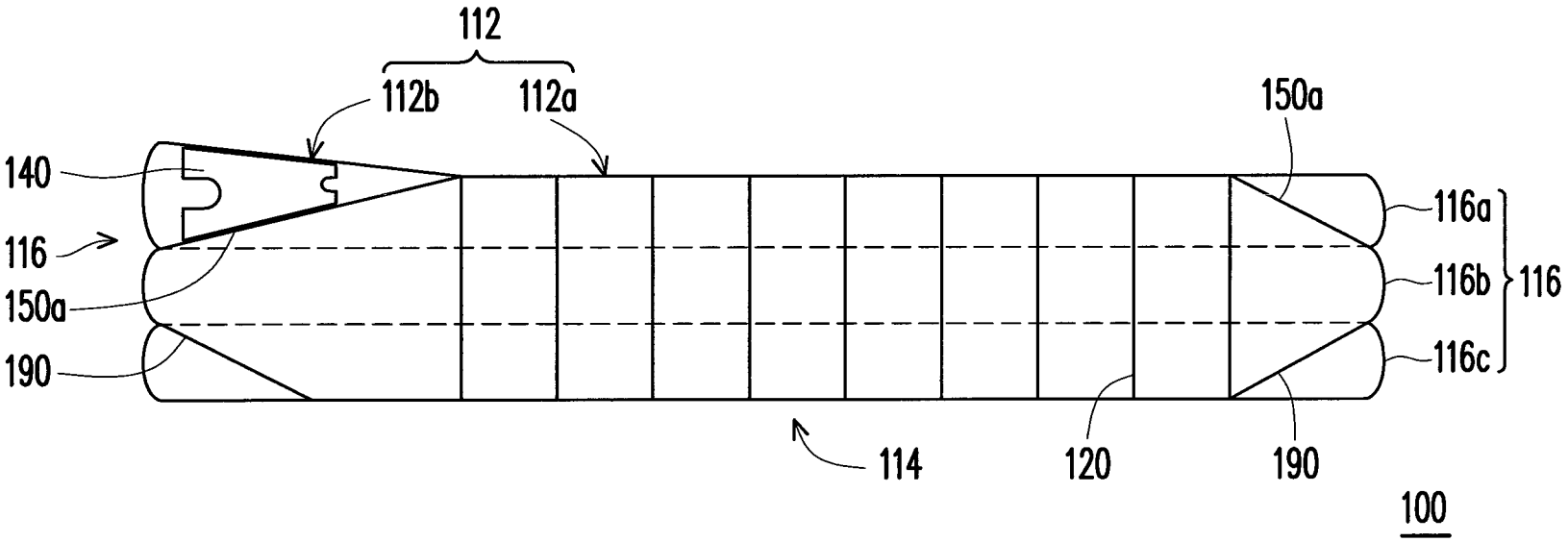
FIG. 8 is a cross-sectional view of an air mattress along the length direction according to another exemplary embodiment of the present invention.
Figure 9:
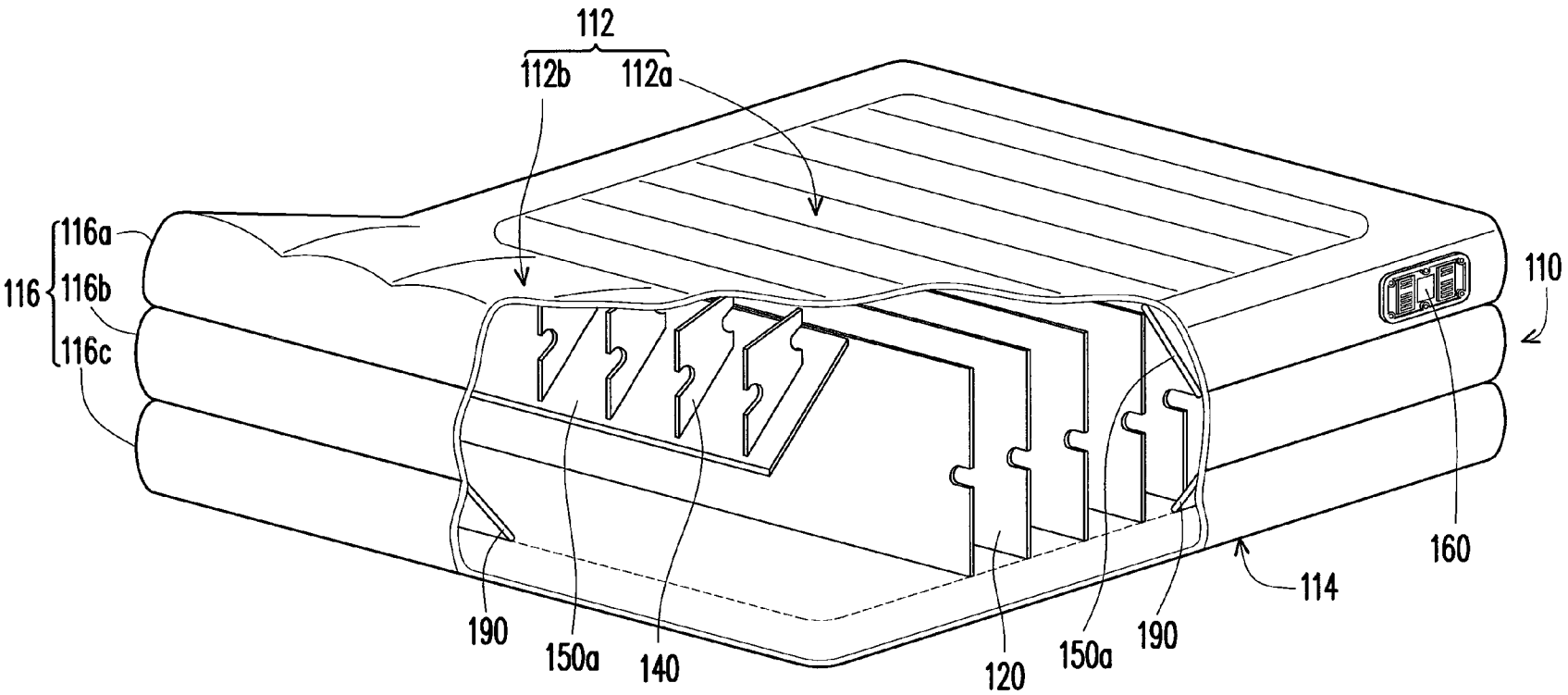
FIG. 9 is a schematic perspective view of the air mattress of FIG. 8.

FIG. 8 is a cross-sectional view of an air mattress along the length direction according to another exemplary embodiment of the present invention. FIG. 9 is a schematic perspective view of the air mattress of FIG. 8. Referring to FIG. 8 and FIG. 9, the air mattress 100 includes an inflatable compartment 110, a plurality of strips 120, a first peripheral strip 150*a*, a second peripheral strip 190 and a plurality of pillow strips 140, wherein the strips 120, the first peripheral strip 150*a*, the second peripheral strip 190 and the pillow strips 140 are air-pervious disposed in the inflatable compartment 110. The inflatable compartment 110 includes a top wall 112, a bottom wall 114 and a side wall 116 surrounding peripheries of the top wall 112 and the bottom wall 114. The top wall 112 includes a pillow portion 112*b* and a lying portion 112*a*. The strips 120 are arranged substantially parallel to the width direction of the air mattress 100 and respectively connected between the bottom wall 114 and the lying portion 112*a* of the top wall 112.

As mentioned above, the first peripheral strip 150*a* surrounds the strips 120 and incliningly connected between the side wall 116 and the top wall 112. The pillow strips 140 are arranged substantially parallel to the length direction of the air mattress 100 and directly connected between the first peripheral strip 150*a* and the pillow portion 112*b* of the top wall 112. The second peripheral strip 190 surrounds the strips 120 and incliningly connected between the side wall 116 and the bottom wall 114, wherein the position of the lower edge of the first peripheral strip 150*a* connected to the side wall 116 is higher than the position of the upper edge of the second peripheral strip 190 connected to the side wall 116, thus the side wall 116 is formed into a first layer portion 116*a*, a second layer portion 116*b* and a third layer portion 116*c*.

Similarly, the functions and shapes of the side wall 116, strips 120, pillow strips 140, first peripheral strip 150*a* and second peripheral strip 190 of the air mattress 100 are similar or the same to the functions and shapes of the side wall, strips, pillow strips and peripheral strip of the air mattress of the embodiment shown in FIG. 7, thus the detailed description of the design can be referred to FIG. 7 and related FIG. 1, FIG. 2, FIG. 3 and FIG. 5A to FIG. 5E, and it is not repeated herein. However, it has to be noted that the height of the pillow strips 140 is smaller located relatively nearer to the connecting location of the first peripheral strip 150*a* and the top wall 112, since the lower edge of each of the strips 140 is directly connected on the first peripheral strip 150*a*.

Figure 10:
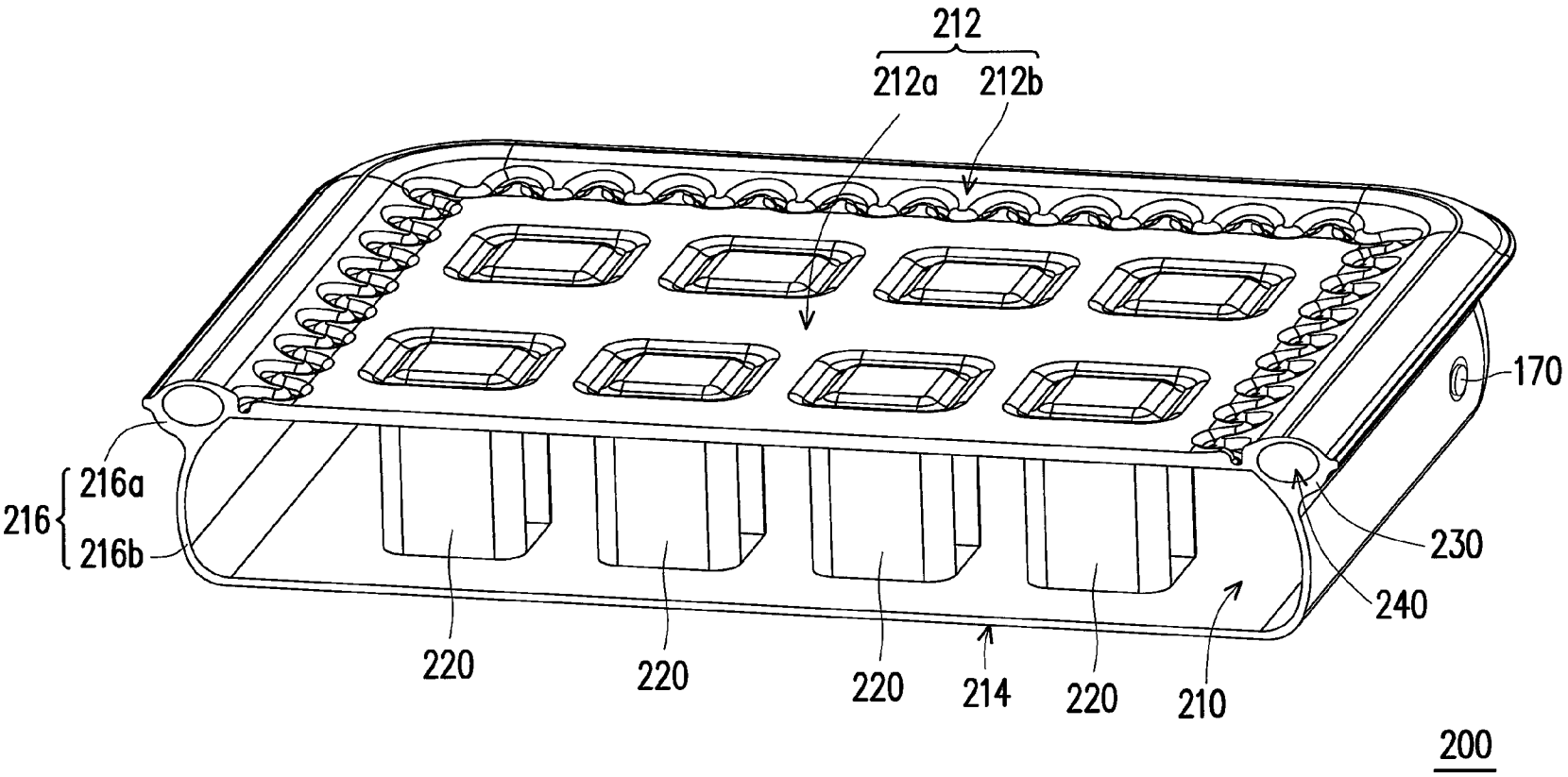
FIG. 10 is a partial perspective view of an air mattress according to another exemplary embodiment of the present invention.
Figure 11:
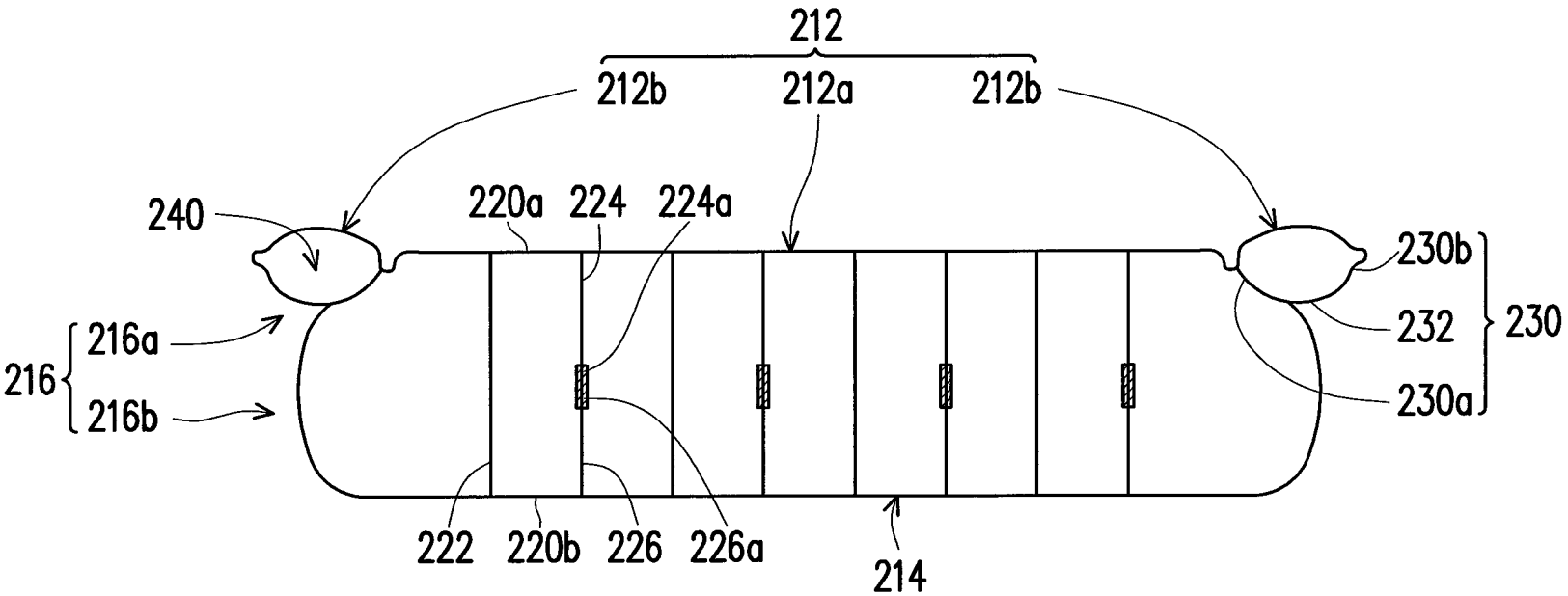
FIG. 11 is a schematic cross-sectional view along the length direction of the air mattress of FIG. 10.

FIG. 10 is a partial perspective view of an air mattress according to another exemplary embodiment of the present invention. FIG. 11 is a schematic cross-sectional view along the length direction of the air mattress of FIG. 10. Referring to FIG. 10 and FIG. 11, in the embodiment, the air mattress 200 includes an inflatable compartment 210, a plurality of strips 220 and a plurality of decoration strips 230. The inflatable compartment 210 is formed by a surround consisting of a top wall 212, a bottom wall 214 and a side wall 216, wherein the top wall 212 includes a lying portion 212*a* and a decoration portion 212*b*, and the side wall 216 surrounds the peripheries of the top wall 212 and the bottom wall 214. In the embodiment, the strips 220 are disposed in the inflatable compartment 210 and respectively connected to the lying portion 212*a* of the top wall 212 and the bottom wall 214.

In order to form the air mattress 200 having the comparatively higher decoration portion 212*b* around the lying portion 212*a*, the side wall 216 (referring to FIG. 12A) of the embodiment is designed to have regions with substantially equal heights, and the decoration strips 230 (referring to FIG. 12D) are connected to each other and surround the lying portion 212*a* of the top wall 212.

Specifically, each of the decoration strips 230 has a dragging portion 232. The upper end 230*a* of the decoration strip 230 and the lower end 230*b* of the decoration strip 230 are respectively connected to the two ends of the decoration portion 212*b*, and the dragging portion 232 of each of the decoration strips 230 is connected to the side wall 216. Thus, when the decoration strips 230 are connected to the top wall 212 and the side wall 216, the decoration strip 230 and the decoration portion 212*b* of the top wall 212 are formed into another inflatable compartment 240 so as to form the decoration portion 212*b*. Accordingly, the side wall 216 is formed into a first layer portion 216*a* and a second layer portion 216*b*. In other words, through the configuration of the decoration strips 230 of the air mattress 200 which merely having the top wall 212 and the bottom wall 214, the user can obtain the side wall 216 with a double-layered structure and is no need to stack an extra mattress onto the air mattress 200. In addition, the height of the decoration portion 212*b* of the top wall 212 is greater than the height of the lying portion 212*a* of the top wall 212, so as to form an enclosing square to enhance the decorative effect and better the overall appearance of the air mattress 200.

Compared to the embodiments mentioned above, in the embodiment of FIG. 10, there is no peripheral strip disposed in the air mattress 200. In other words, the side wall 216 with a double-layered structure can be obtained without the need of peripheral strips in this embodiment. Accordingly, by such configuration, compared to the above mentioned embodiments, the air mattress 200 of the present embodiment can save the material and manufacturing cost and labor of the peripheral strips, and the appearance of the air mattress 200 can be more artistic.

In addition, in other embodiments, the quantity of the decoration strips 230 may be other suitable number and connected to each other and surround the lying portion 212*a* of the top wall 212, or, only one integrated decoration strip 230 may surround the lying portion 212*a* of the top wall 212, but the present invention is not limited thereto.

In the present embodiment, the air mattress 200 further includes an inflating device 160 and a deflating valve 170 as shown in FIG. 3. It has to be mentioned that, the function and structure of the inflating device 160 and the deflating valve 170 of the present embodiment can be referred to the description of FIG. 3, and it is not repeated herein.

In addition, the inflatable compartment 210 and another inflatable compartment 240 of the present embodiment are made by an air-impermeable material, for example a plastic material such as polyvinyl. Thus, after the inflatable compartment 210 and another inflatable compartment 240 of the air mattress 200 are inflated, the air cannot leak out and is maintained within the inflatable compartment 210 and another inflatable compartment 240. In addition, the strips 220, the decoration strips 230, and other components may be made by the aforementioned polyvinyl or other materials.

Figure 12A:
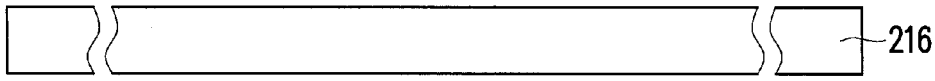
FIG. 12A shows the expanded view of the side wall of FIG. 10.
Figure 12B:
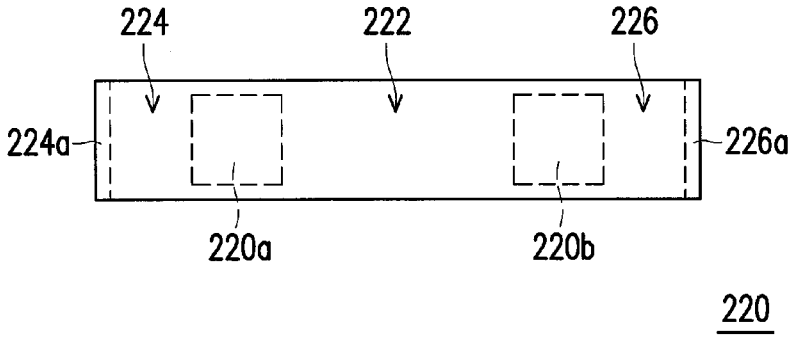
FIG. 12B shows the expanded view of a strip of FIG. 10.
Figure 12C:
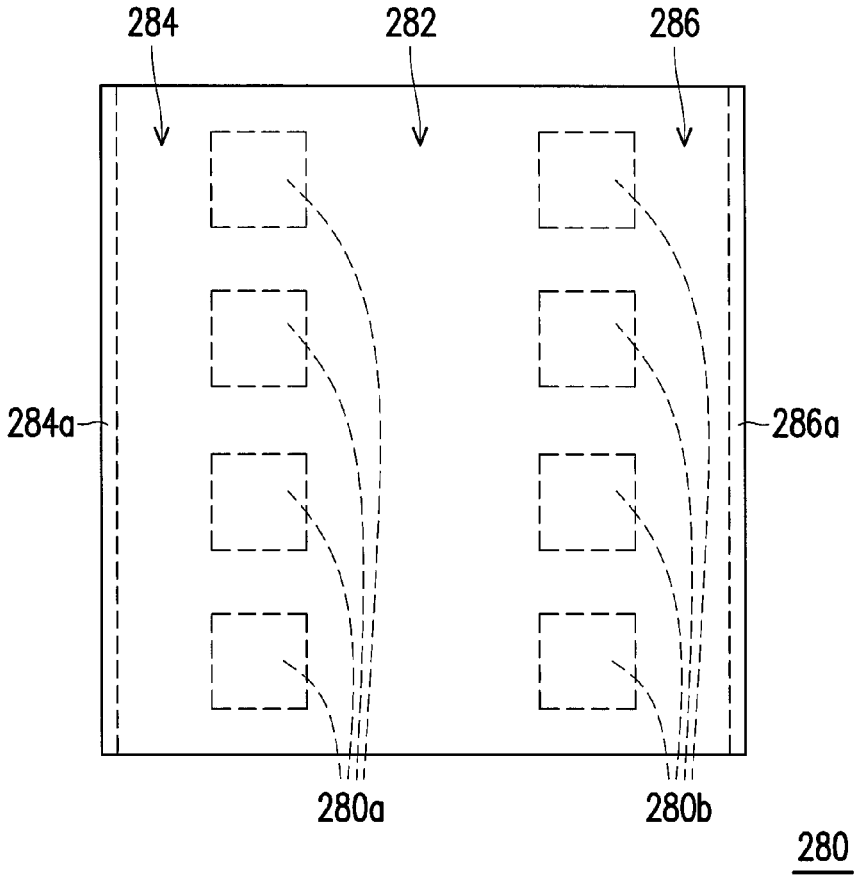
FIG. 12C shows the expanded view of a strip of FIG. 10.
Figure 12D:
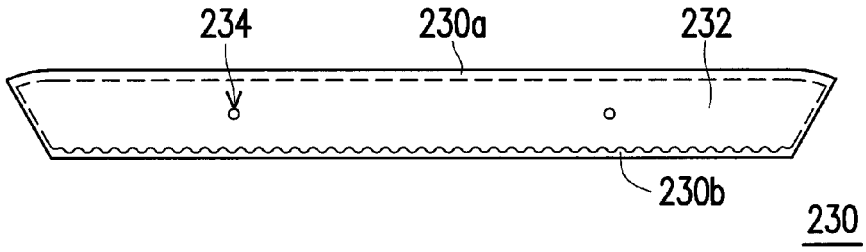
FIG. 12D shows the expanded view of a decoration strip of FIG. 10.

The shapes of the aforementioned side wall 216, the strips 220 and the decoration strips 230 are not limited in the present invention and described accompanying with figures in the following. FIG. 12A shows the expanded view of the side wall of FIG. 10. FIG. 12B shows the expanded view of a strip of FIG. 10. FIG. 12C shows the expanded view of a strip of FIG. 10. FIG. 12D shows the expanded view of a decoration strip of FIG. 10. First, referring to FIG. 12A, FIG. 10 and FIG. 11, in the embodiment, the top wall 212 does not have a pillow portion as shown in FIG. 1, thus the side wall 216 is designed to have a plurality of regions with substantially equal heights.

In the embodiment, through the structure design of the strips 220, the overall appearance of the air mattress 200 can become smoother and squarer to have a better appearance, and the comfort can be increased. It is further described with examples in the following. Referring to FIG. 12B, FIG. 10 and FIG. 11 together, the strips 220 of the present embodiment are different from the strips 120 shown in FIG. 5B, FIG. 1 and FIG. 2. The strips 220 of the present embodiment are arranged in array substantially along the length direction and the width direction of the air mattress 200, wherein four strips 220 are substantially arranged parallel and along the width direction of the air mattress 200, and four strips 220 are substantially arranged parallel and along the length direction of the air mattress 200. However, the number of the strips 220 can be adjusted as required according to practical applications, and the present invention is not limited thereto.

Specifically, each of the strips 220 has a first supporting portion 222, a second supporting portion 224 and a third supporting portion 226. The end of the second supporting portion 224 outwardly extends to form a first reserved portion

224*a*. The end of the third supporting portion 226 outwardly extends to form a second reserved portion 226*a*. Accordingly, the first reserved portion 224*a* is connected to the second reserved portion 226*a*, so that the first supporting portion 222, the second supporting portion 224 and the third supporting portion 226 face the side wall 216. In the embodiment, the method of the first reserved portion 224*a* connecting to the second reserved portion 226*a* is not limited in the present invention, for example by adhesive bonding method or thermal welding method can be used. For example, the first reserved portion 224*a* is connected to the second reserved portion 226*a* by using the thermal welding method so that the connection can be more stable. Thus, the connection between the first reserved portion 224*a* and the second reserved portion 226*a* is hard to break, after the air mattress 200 is inflated.

Moreover, the first supporting portion 222 may slightly be square, and the shape of the second supporting portion 224 and the third supporting portion 226 after connected to each other may slightly be square, and the height of the first supporting portion 222 is substantially equal to the height of the second supporting portion 224 and the third supporting portion 226 after connected to each other. In other embodiments of the invention, the first supporting portion 222, the second supporting portion 224 and the third supporting portion 226 can be in any other shapes, and the present invention is not limited thereto.

Specifically, each of the strips 220 has a first connecting portion 220*a* and a second connecting portion 220*b*. The first connecting portion 220*a* is located between the first supporting portion 222 and the second supporting portion 224. The second connecting portion 220*b* is located between the first supporting portion 222 and the third supporting portion 226. The first connecting portion 220*a* faces the lying portion 212*a* of the top wall 212 and is connected to lying portion 212*a* of the top wall 212. The second connecting portion 220*b* faces the bottom wall 214 and is connected to the bottom wall 214.

In such configuration, the shapes of the first connecting portion 220*a* and the second connecting portion 220*b* of each of the strips 220 of the present embodiment are substantially square. Accordingly, when the inflatable compartment 210 is expanded after the air mattress 200 is inflated, the first connecting portion 220*a* connected to the top wall 212 and the second connecting portion 220*b* connected to the bottom wall 214 may provide fixedness of the length direction and the width direction, so that the expansion deformation of the top wall 212 and the bottom wall 214 after the air mattress 200 is inflated can be reduced, thus the overall appearance of the air mattress 200 can be smoother and squarer. Therefore, the user would be more comfortable when using the air mattress and the air mattress 200 has a better appearance. In other embodiments of the invention, the first connecting portion 220*a* and the second connecting portion 220*b* can be in any other shapes, and the present invention is not limited thereto.

The strips 220 of FIG. 12B are a plurality of single members, wherein each of the strips 220 has a first connecting portion 220*a* and a second connecting portion 220*b*, is disposed in the inflatable compartment 210, and four strips 220 are disposed substantially in parallel along the length direction of the air mattress 200. Nevertheless, the present invention should not be construed as limited to the embodiments set forth herein. In other embodiments, the quantity of the strips 220 may be other suitable number and the strips 220 are connected to each other, or only one integrated strip 280, but the present invention is not limited thereto. Detailed explanations are given with figures below.

Referring to FIG. 12C, in the embodiment, the strip 280 has a first supporting portion 282, a second supporting portion 284 and a third supporting portion 286. The end of the second supporting portion 284 outwardly extends to form a first reserved portion 284*a*. The end of the third supporting portion 286 outwardly extends to form a second reserved portion 286*a*. The first reserved portion 284*a* is connected to the second reserved portion 286*a*, so that the first supporting portion 282, the second supporting portion 284 and the third supporting portion 286 face the side wall 216. In the embodiment, the method of the first reserved portion 284*a* connecting to the second reserved portion 286*a* is not limited in the present invention, for example by adhesive bonding method or thermal welding method can be used. For example, the first reserved portion 284*a* is connected to the second reserved portion 286*a* by using the thermal welding method so that the connection can be more stable. Thus, the connection between the first reserved portion 284*a* and the second reserved portion 286*a* is hard to break, after the air mattress 200 is inflated.

Moreover, the strips 280 are arranged substantially parallel to the length direction of the air mattress 200 and respectively connected between the lying portion 212*a* of the top wall 212 and the bottom wall 214. Thus, in the embodiment, through the configuration of the strips 280, the air mattress 200 needs only one strip 280 in one direction, wherein the strip 280 has four connecting portions (referred to the first connecting portion 280*a* or the second connecting portion 280*b*), and it is unnecessary to dispose the four strips 220 as shown in FIG. 11. In this way, the efficiency of the manufacturing of air mattress 200 is increased.

The strip 280 has four first connecting portions 280*a* and four second connecting portions 280*b*. The first connecting portions 280*a* are located between the first supporting portion 282 and the second supporting portion 284. The second connecting portions 280*b* are located between the first supporting portion 282 and the third supporting portion 286. The first connecting portions 280*a* face the top wall 212 and are respectively connected to the top wall 212. The second connecting portions 280*b* face the bottom wall 214 and are respectively connected to the bottom wall 214.

Moreover, the first supporting portion 282 may slightly be square, and the shape of the second supporting portion 284 and the third supporting portion 286 after connected to each other may slightly be square, and the height of the first supporting portion 282 is substantially equal to the height of the second supporting portion 284 and the third supporting portion 286 after connected to each other. In other embodiments of the invention, the first supporting portion 282, the second supporting portion 284 and the third supporting portion 286 can be in any other shapes, and the present invention is not limited thereto.

In such configuration, the shapes of the first connecting portion 280*a* and the second connecting portion 280*b* of each of the strips 280 of the present embodiment are substantially square. Accordingly, when the inflatable compartment 210 is expanded after the air mattress 200 is inflated, the first connecting portion 280*a* connected to the top wall 212 and the second connecting portion 280*b* connected to the bottom wall 214 may provide fixedness of the length direction and the width direction, so that the expansion deformation of the top wall 212 and the bottom wall 214 after the air mattress 200 is inflated can be reduced, thus the overall appearance of the air mattress 200 can be smoother and squarer. Therefore, the user would be more comfortable when using the air mattress and the air mattress 200 has a better appearance. In other embodiments of the invention, the first connecting portion 280*a* and the second connecting portion 280*b* can have any other shapes and quantity, and the present invention is not limited thereto.

FIG. 12D shows the expanded view of a decoration strip of FIG. 10. Referring to FIG. 12D, FIG. 10 and FIG. 11, further in the embodiment, the decoration strip 230 has a plurality of through holes 234. Therefore, the air within the inflatable compartment 240 may flow through the through holes 234, so that the decoration strip 230 is air-pervious and may not cause the air-flow prevention between the inflatable compartment 210 and another inflatable compartment 240. However, besides the through holes 234 may not cause air-flow prevention between the inflatable compartment 210 and another inflatable compartment 240, the through holes 234 may also provide damping to the decoration strip 230 from being exerted by tensile force of the top wall 212 and the side wall 216. Thus, after the inflatable compartment 210 and another inflatable compartment 240 is expanded after the air mattress 200 is inflated, the design of the decoration strip 230 may greatly prevent the decoration strip 230 from being stripped from the top tall 212 and/or the side wall 216 connected therebetween or the decoration strip 230 from being broken.

In the embodiment, the method of the decoration strip 230 connecting to the top wall 212 is not limited in the present invention, for example by adhesive bonding method or thermal welding method. For example, the decoration strip 230 is connected to the top wall 212 by using the thermal welding method so that the connection can be more stable.

Figure 13:
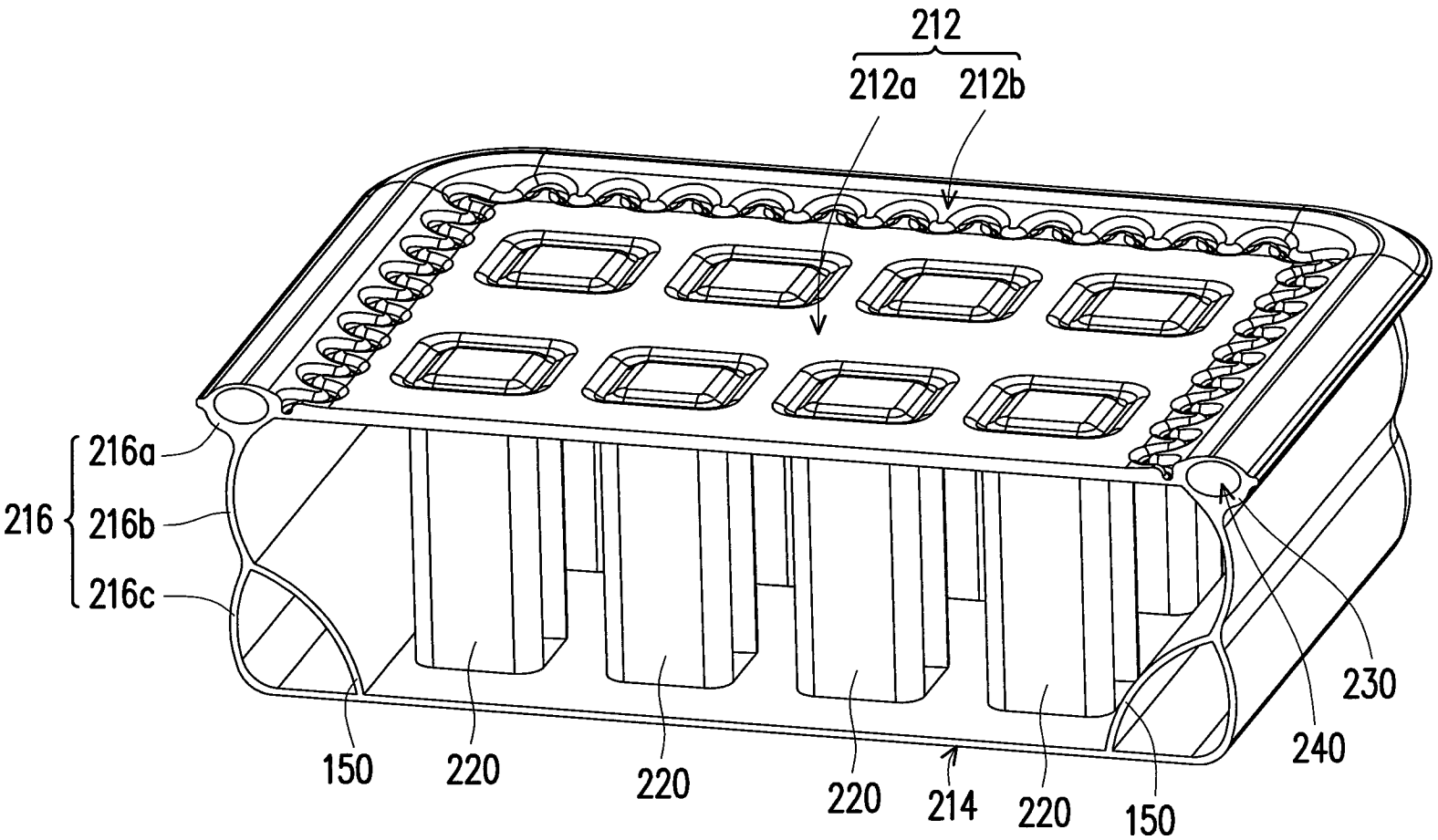
FIG. 13 is a partial perspective view of an air mattress according to another exemplary embodiment of the present invention.

FIG. 13 is a partial perspective view of an air mattress according to another exemplary embodiment of the present invention. Referring to FIG. 13, in the embodiment, the air mattress 200 includes an inflatable compartment 210, a plurality of strips 220 and a plurality of decoration strips 230. The inflatable compartment 210 is formed by a surround consisting of a top wall 212, a bottom wall 214 and a side wall 216, wherein the side wall 216 surrounds the peripheries of the top wall 212 and the bottom wall 214. In the embodiment, the strips 220 are disposed in the inflatable compartment 210 and respectively connected to the lying portion 212*a* of the top wall 212 and the bottom wall 214.

It has to be mentioned that, the difference between the present embodiment and the embodiment mentioned in FIG. 10 is: the air mattress 200 of the present embodiment further includes a peripheral strip 150 as shown in FIG. 5E. The peripheral strip 150 is air pervious and disposed in the inflatable compartment 210. The peripheral strip 150 is incliningly connected between the bottom wall 214 and the side wall 216, and the peripheral strip 150 surrounds the strips 220. In other embodiments, the quantity of the peripheral strips 150 may be other suitable number and the peripheral strips are connected to each other and surround the strips 220, or only one integrated peripheral strip 150 may surround the strips 220, but the present invention is not limited thereto. On the other hand, another end of the peripheral strip 150 is connected to the corresponding side wall 216, wherein the position of the decoration strip 230 connected to the side wall 216 is higher than the position of the peripheral strip 150 connected to the side wall 216, thus the side wall 216 is formed into a first layer portion 216*a*, a second layer portion 216*b* and a third layer portion 216*c*. In other words, besides through the configuration of the decoration strips 230 to form the first layer portion 216*a* and the second layer portion 216*b*, through the configuration of the peripheral strip 150 as shown in FIG. 5E, the air mattress 200 can also achieve the side wall 216 with a double-layered structure.

Specifically, the peripheral strip 150 as shown in FIG. 5E has a dragging portion 152. The upper end 152*a* of the dragging portion 152 and the lower end 152*b* of the dragging portion 152 are connected to the side wall 216 and the bottom wall 214, respectively. In addition, the peripheral strip 150 further includes a plurality of through holes 156. Therefore, the air within the inflatable compartment 210 may flow through the through holes 156, so that the peripheral strip 150 is air-pervious and may not cause the air-flow prevention within the inflatable compartment 210. However, besides the through holes 156 may not cause air-flow prevention within the inflating compartment 210, the through holes 156 may also provide damping to the peripheral strip 150 from being exerted by tensile force of the bottom wall 214 and the side wall 216. Thus, after the inflatable compartment 210 of the air mattress 200 is inflated, the design of the through holes 156 may greatly prevent the peripheral strip 150 from being extracted from the bottom wall 214 and/or the side wall 216 connected therebetween or the peripheral strip 150 from being broken.

The functions and shapes of the side wall 216, strips 220 and decoration strips 230 of the air mattress 200 of the present embodiment are similar or the same to the functions and shapes of the side wall, strips and decoration strip of the air mattress of the above mentioned embodiment, thus the detailed description of the design can be referred to FIG. 10, FIG. 11, FIG. 12A to FIG. 12D, and it is not repeated herein.

In addition, in the embodiment as shown in FIG. 13 and other embodiments, the position of the peripheral strip with different heights connected to the side wall is not limited in the present invention. In other words, position of the peripheral strip connected to the side wall is not limited in the air mattress of other embodiments of the present invention, as long as the side wall may be formed into a multi-layered structure. Detailed explanations are given with figures below.

Figure 14:
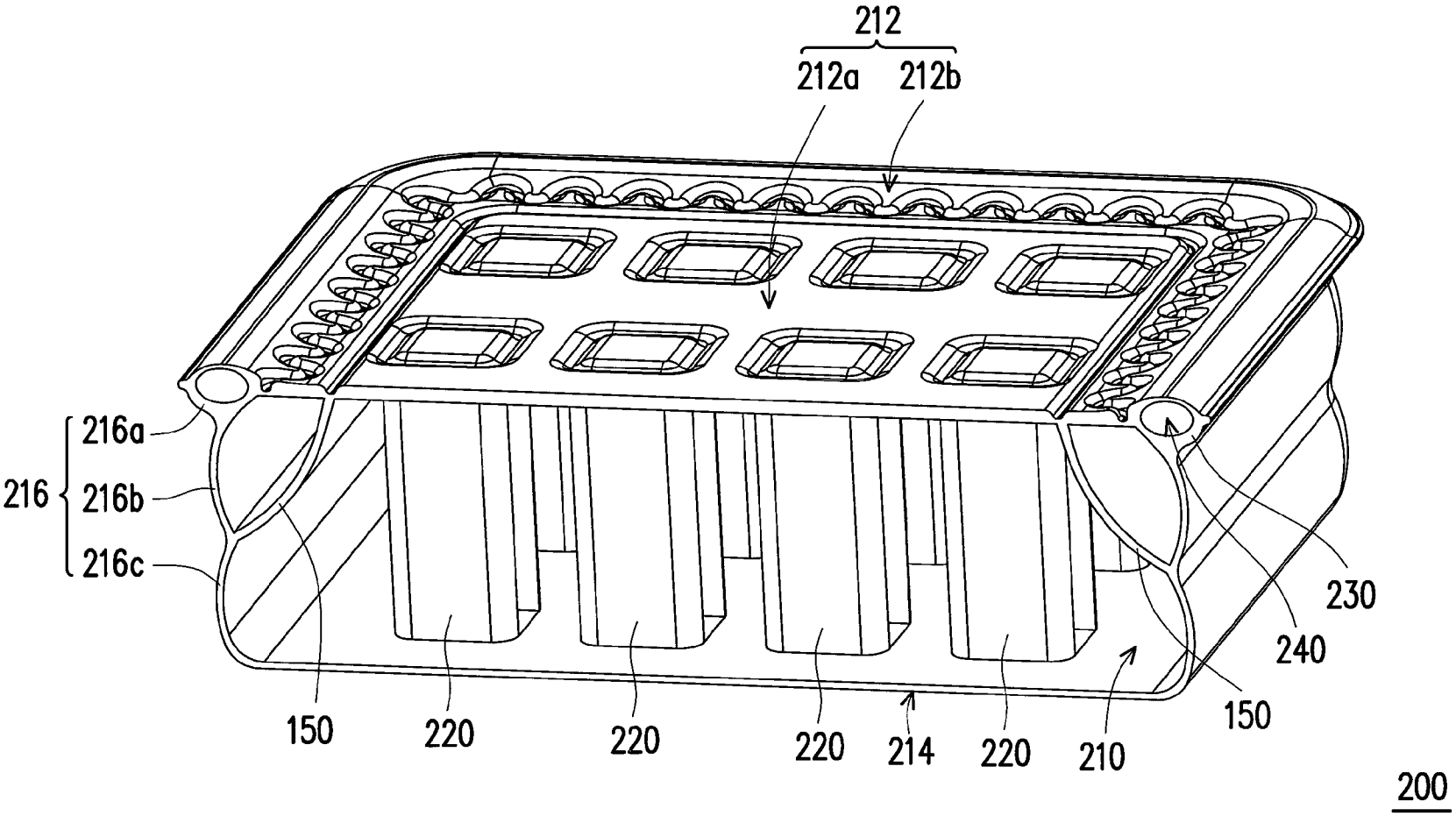
FIG. 14 is a partial perspective view of an air mattress according to another exemplary embodiment of the present invention.

FIG. 14 is a partial perspective view of an air mattress according to another exemplary embodiment of the present invention. Referring to FIG. 14, in the air mattress 200 of the present embodiment, the peripheral strip 150 is incliningly connected to the side wall 216 and the edge of the lying portion 212*a* of the top wall 212, wherein the position of the decoration strip 230 connected to the side wall 216 is higher than the position of the lower end of the peripheral strip 150 connected to the side wall 216, thus the side wall 216 is formed into a first layer portion 216*a*, a second layer portion 216*b* and a third layer portion 216*c*.

Similarly, the functions and shapes of the side wall 216, strips 220, decoration strips 230 and peripheral strip 150 of the air mattress 200 of the present embodiment are similar or the same to the functions and shapes of the side wall, strips, decoration strip and peripheral strip of the air mattress of the above mentioned embodiment, thus the detailed description of the design can be referred to FIG. 10, FIG. 11, FIG. 12A to FIG. 12D and FIG. 13, and it is not repeated herein.

In addition, in other embodiments similar to the embodiment as shown in FIG. 13 and FIG. 14, quantity of the peripheral strip with different heights connected to the side wall is not limited in the present invention. In other words, quantity of the layer structure formed by the side wall is not limited in the air mattress of other embodiments of the present invention, and examples are described accompanying with figures in the following.

Figure 15:
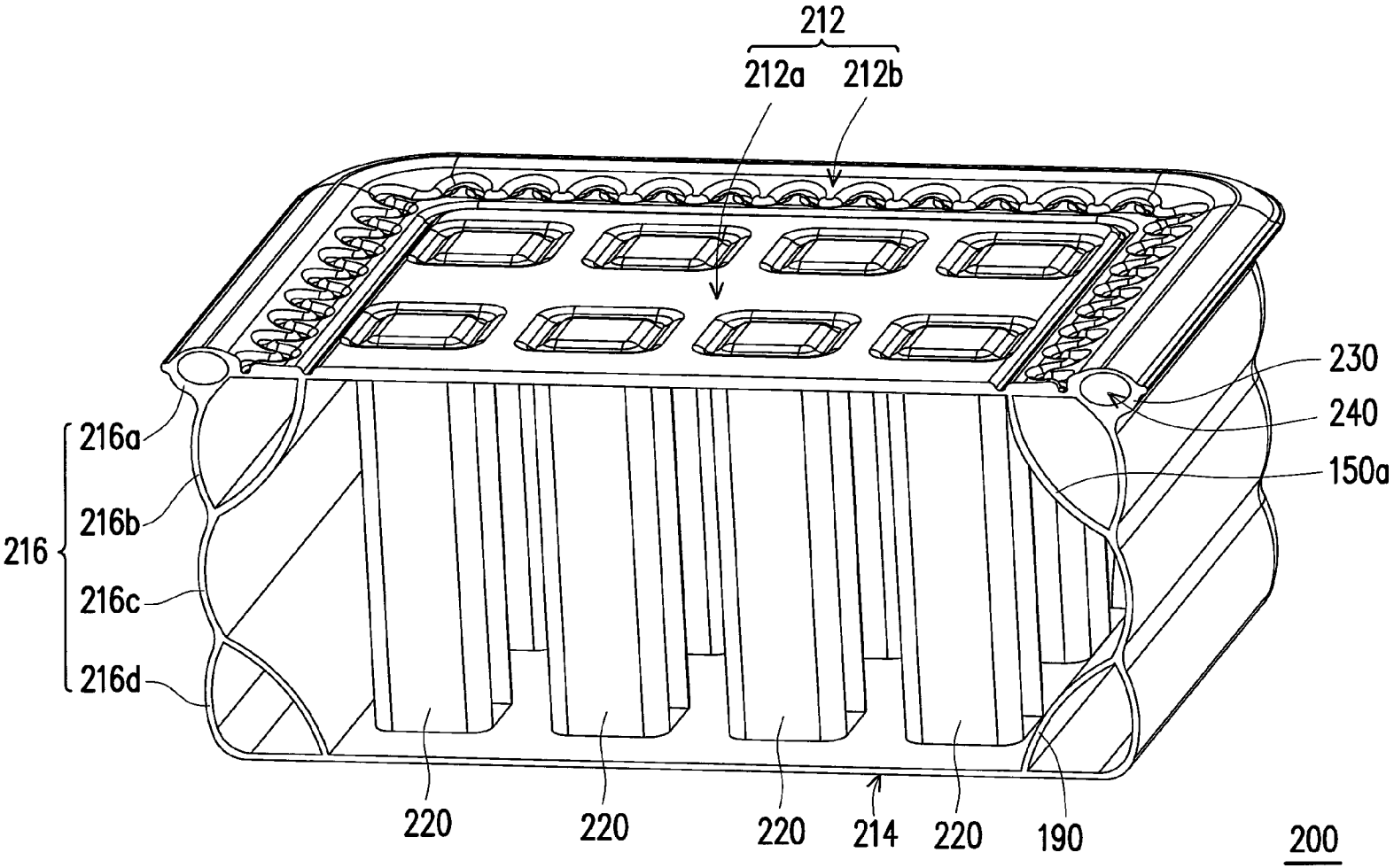
FIG. 15 is a partial perspective view of an air mattress according to another exemplary embodiment of the present invention.
Figure 16:
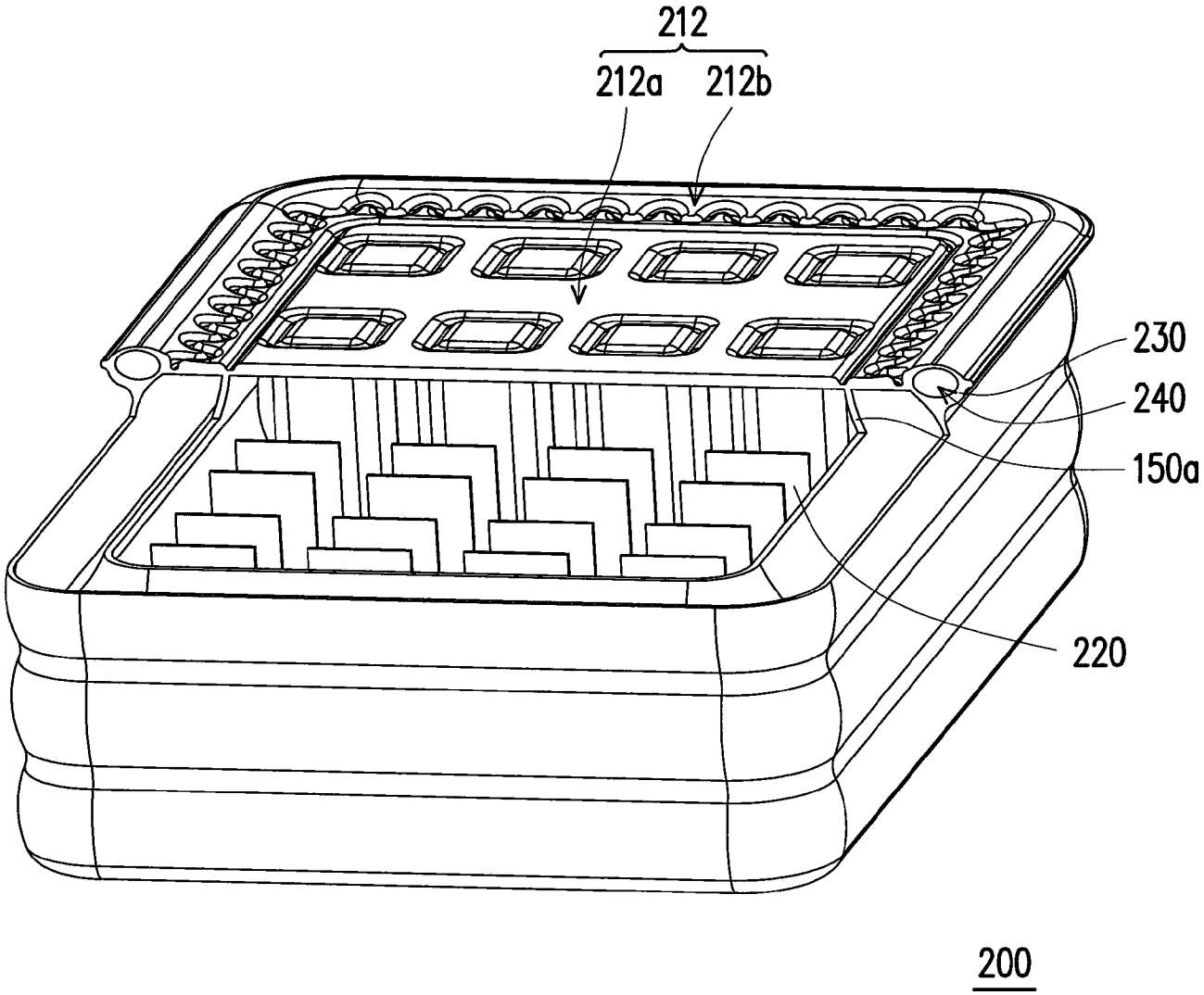
FIG. 16 is a partial perspective view of the air mattress of FIG. 15.

FIG. 15 is a partial perspective view of an air mattress according to another exemplary embodiment of the present invention. FIG. 16 is a partial perspective view of the air mattress of FIG. 15. Referring to FIG. 15 and FIG. 16, in the embodiment, the air mattress 200 includes an inflatable compartment 210, a plurality of strips 220 and a plurality of decoration strips 230. The inflatable compartment 210 is formed by a surround consisting of a top wall 212, a bottom wall 214 and a side wall 216, wherein the side wall 216 surrounds the peripheries of the top wall 212 and the bottom wall 214. In the embodiment, the strips 220 are disposed in the inflatable compartment 210 and respectively connected to the lying portion 212*a* of the top wall 212 and the bottom wall 214.

It has to be mentioned that, the difference between the present embodiment and the embodiment mentioned in FIG. 13 and FIG. 14 is: the air mattress 200 of the present embodiment further includes a first peripheral strip 150*a* and a second peripheral strip 190 as shown in FIG. 6, wherein the first peripheral strip 150*a* and the second peripheral strip 190 are connected to the different heights of the side wall 216. The first peripheral strip 150*a* and the second peripheral strip 190 are air pervious and disposed in the inflatable compartment 210. The first peripheral strip 150*a* surrounds the strips 220 and is connected to the side wall 216 and the top wall 212. The second peripheral 190 surrounds the strips 220 and inclingly connected between the side wall 216 and the bottom wall 214, wherein the position of the lower edge of the first peripheral strip 150*a* connected to the side wall 216 is higher than the position of the upper edge of the second peripheral strip 190 connected to the side wall 216, thus the side wall 216 is formed into a first layer portion 216*a*, a second layer portion 216*b*, a third layer portion 216*c* and a fourth layer portion 216*d*. In other words, besides through the configuration of the decoration strips 230 to form the first layer portion 216*a* and the second layer portion 216*b*, through the configuration of the first peripheral strip 150*a* and the second peripheral strip 190, the air mattress 200 can also achieve the side wall 216 with a four-layered structure.

Similarly, the functions and shapes of the side wall 216, strips 220 and decoration strips 230 of the air mattress 200 of the present embodiment are similar or the same to the functions and shapes of the side wall, strips and decoration strip of the air mattress of the above mentioned embodiment, thus the detailed description of the design can be referred to FIG. 10, FIG. 11, FIG. 12A to FIG. 12D, and it is not repeated herein.

In addition, in other embodiments similar to the embodiment as shown in FIG. 13 to FIG. 16, the strips of the air mattress are single members (as shown in FIG. 12B), and the structure and manufacturing method of the strips of the air mattress are not limited in the present invention. In other words, the structure of the strips of the air mattress being single members is not limited other embodiments of the present invention, and examples are described with figures in the following.

Figure 17:
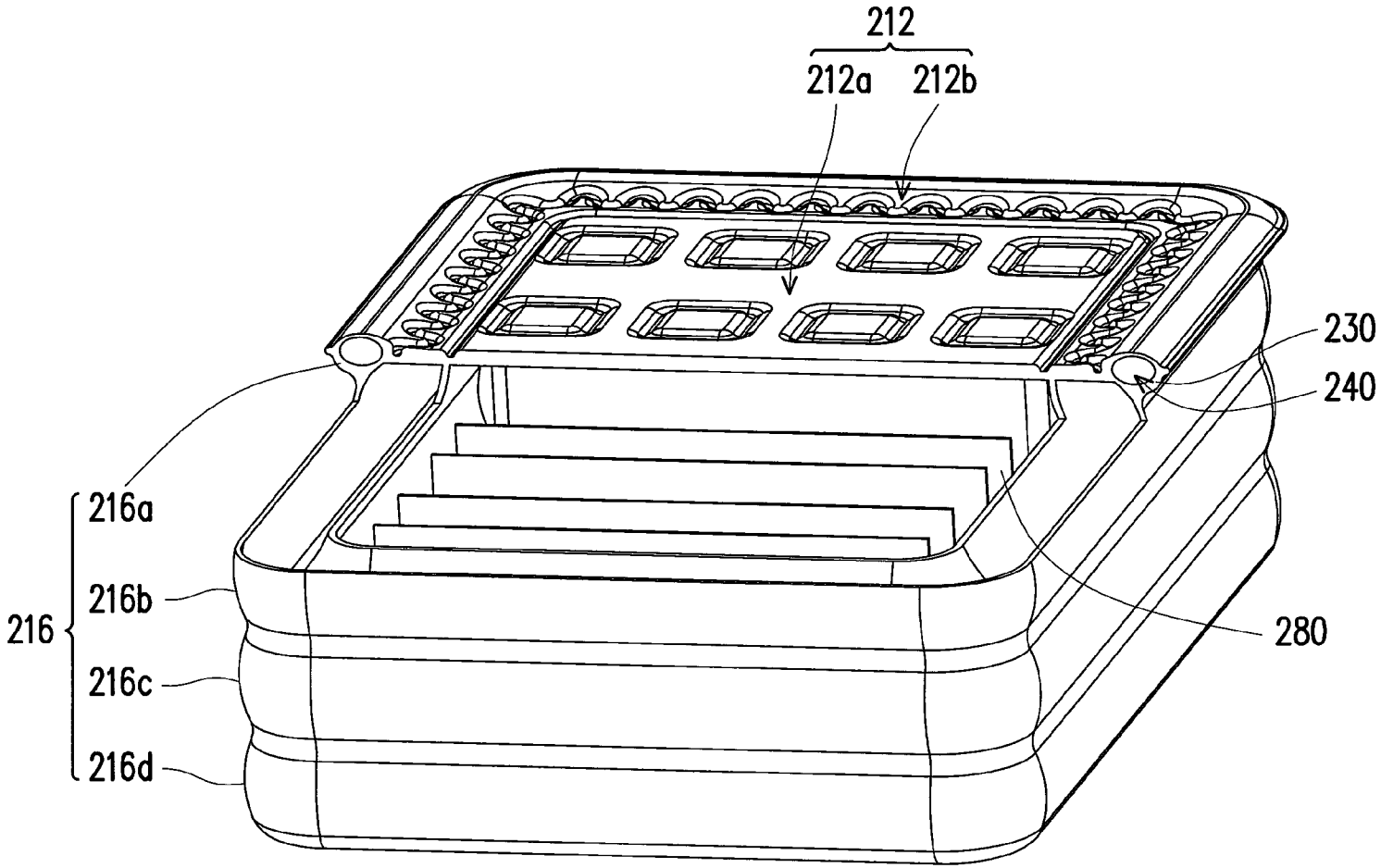
FIG. 17 is a partial perspective view of an air mattress according to another exemplary embodiment of the present invention.

FIG. 17 is a partial perspective view of an air mattress according to another exemplary embodiment of the present invention. Referring to FIG. 17 and FIG. 12C, the difference between the present embodiment and the embodiment mentioned in FIG. 15 and FIG. 16 is: the air mattress 200 includes the strips 280 shown in FIG. 12C. The strips 280 are disposed in the inflatable compartment 210, arranged substantially parallel to the length direction of the air mattress 200 and respectively connected between the lying portion 212*a* of the top wall 212 and the bottom wall 214.

Specifically, each of the strips 280 has four first connecting portions 280*a* and four second connecting portions 280*b* shown in FIG. 12C. The first connecting portions 280*a* are located between the first supporting portion 282 and the second supporting portion 284. The second connecting portions 280*b* are located between the first supporting portion 282 and the third supporting portion 286. The first connecting portions 280*a* face the top wall 212 and are respectively connected to the top wall 212. The second connecting portions 280*b* face the bottom wall 214 and are respectively connected to the bottom wall 214. Thus, in the embodiment, through the configuration of the strips 280, the air mattress 200 has a plurality of connecting portions (referred to the first connecting portion 220*a* or the second connecting portion 220*b*), and as shown in FIG. 11, it is unnecessary that the strip 220 has a connecting portion (referred to the first connecting portion 220*a* or the second connecting portion 220*b*), thus the efficiency of the air mattress 200 can be improved. It has to be mentioned that, the function and effect of the strip 280 have been described in FIG. 12C, and please refer to the descriptions of FIG. 12C, it is not repeated herein.

Similarly, the functions and shapes of the side wall 216, strips 280, first peripheral strip 150*a* and second peripheral strip 190 of the air mattress 200 of the present embodiment are similar or the same to the functions and shapes of the side wall, strips, decoration strip, first peripheral strip and second peripheral strip of the air mattress of the above mentioned embodiment, thus the detailed description of the design can be referred to FIG. 10, FIG. 11, FIG. 12A to FIG. 12D, FIG. 15 and FIG. 16, and it is not repeated herein.

In light of the foregoing, in the present invention, through the decoration strips, the side wall of the air mattress may be formed into a two-layered structure. In such configuration, through the disposing of decoration strips, without needing to stack an extra mattress onto the air mattress, the mattress can be formed into a two-layered side wall. The overall appearance of the air mattress is further improved. In addition, through the structure design of the strips of the air mattress of the present invention, the user would feel much more comfortable when using the air mattress, and the expansion deformation of the top wall and the bottom wall after the air mattress is inflated can be reduced, thus the overall appearance of the air mattress can be smoother and squarer and the air mattress has a better appearance.

In addition, comfort and convenience of the air mattress of the embodiment of present invention is further increased because of the design of inner structure of pillow portion of the air mattress, wherein the top wall of the air mattress is formed with a lying portion and a pillow portion protruded from the lying portion due to the side wall designed with different heights. Accordingly, the user can pillow on the pillow portion of the top wall when lying on the air mattress and does not need to prepare any other pillow or something having pillow function. Furthermore, since pillow strips are added in the pillow portion, the surface of the pillow portion of the air mattress is comparatively smooth and it increases great comfort to the user.

Although the invention has been described with reference to the embodiments thereof, it will be apparent to one of the ordinary skills in the art that modifications to the described embodiments may be made without departing from the spirit of the invention. Accordingly, the scope of the invention will be defined by the attached claims not by the above detailed description.

What is claimed is:

1. An air mattress, comprising:

an inflatable compartment, comprising a top wall, a bottom wall and a side wall surrounding peripheries of the top wall and the bottom wall, wherein the top wall has a lying portion and a decoration portion formed at a periphery of the lying portion;

a plurality of strips, air-pervious and disposed in the inflatable compartment, the strips are connected between the top wall and the bottom wall; and a plurality of decoration strips, surrounding the top wall and connected between the top wall and the side wall, so that the side wall is formed into a first layer portion and a second layer portion, and a height of the decoration portion is greater than a height of a lying portion of the top wall.

2. The air mattress according to claim 1, wherein each of the strips has a first supporting portion, a second supporting portion and a third supporting portion, an end of the second supporting portion outwardly extends to form a first reserved portion, an end of the third supporting portion outwardly extends to form a second reserved portion, the first reserved portion is connected to the second reserved portion so that the first supporting portion, the second supporting portion and the third supporting portion face the side wall.

3. The air mattress according to claim 2, wherein each of the strips has a first connecting portion and a second connecting portion, the first connecting portion is located between the first supporting portion and the second supporting portion, the second connecting portion is located between the first supporting portion and the third supporting portion, the first connecting portion faces the top wall and connected to the top wall, the second connecting portion faces the bottom wall and connected to the bottom wall.

4. The air mattress according to claim 2, wherein each of the strips has a plurality of first connecting portions and a plurality of second connecting portions, the first connecting portions are located between the first supporting portion and the second supporting portion, the second connecting portions are located between the first supporting portion and the third supporting portion, the first connecting portions face the top wall and connected to the top wall, the second connecting portions face the bottom wall and connected to the bottom wall.

5. The air mattress according to claim 1, wherein an upper end and a lower end of each of the decoration strips and two ends of the decoration portion of the top wall are respectively connected, and a dragging portion of each of the decoration strips and the side wall are connected.

6. The air mattress according to claim 1, further comprising a peripheral strip, wherein the peripheral strip is air pervious, disposed in the inflatable compartment, surrounds the strips and connected between the bottom wall and the side wall, so that the side wall is formed into the first layer portion, the second layer portion and the third layer portion.

7. The air mattress according to claim 6, wherein the peripheral strip has a dragging portion, and an upper end and a lower end of the dragging portion are respectively connected to the side wall and the bottom wall.

8. The air mattress according to claim 1, further comprising a first peripheral strip and a second peripheral strip, wherein the first peripheral strip and the second peripheral strip are air pervious and disposed in the inflatable compartment, the first peripheral strip surrounds the strips and connected between the side wall and the top wall, the second peripheral strip surrounds the strips and connected between the side wall and the bottom wall, so that the side wall is formed into the first layer portion, the second layer portion, a third layer portion and a fourth layer portion.

9. The air mattress according to claim 8, wherein the first peripheral strip has a dragging portion, and an upper end and a lower end of the dragging portion are respectively connected to the side wall and the bottom wall.

* * * * *